US007432436B2

(12) United States Patent
Ito et al.

(10) Patent No.: US 7,432,436 B2
(45) Date of Patent: Oct. 7, 2008

(54) APPARATUS AND COMPUTER PROGRAM FOR PLAYING ARPEGGIO

(75) Inventors: Yoshihisa Ito, Hamamatsu (JP); Yasuhiro Kawano, Iwata (JP); Masao Ishibashi, Hamamatsu (JP)

(73) Assignee: Yamaha Corporation (JP)

( * ) Notice: Subject to any disclaimer, the term of this patent is extended or adjusted under 35 U.S.C. 154(b) by 0 days.

(21) Appl. No.: 11/859,304

(22) Filed: Sep. 21, 2007

(65) Prior Publication Data

US 2008/0072744 A1 Mar. 27, 2008

(30) Foreign Application Priority Data

Sep. 21, 2006 (JP) ..... 2006-256534

(51) Int. Cl.
*G10H 1/28* (2006.01)
*G10H 7/00* (2006.01)
*G10H 1/02* (2006.01)

(52) U.S. Cl. ..... 84/638; 84/636

(58) Field of Classification Search ..... 84/612, 84/636, 638, 633, 658, 626, 662
See application file for complete search history.

(56) References Cited

U.S. PATENT DOCUMENTS 6,051,771 A 4/2000 Iizuka 7,091,410 B2 * 8/2006 Ito et al. ..... 84/638

FOREIGN PATENT DOCUMENTS

JP 11-126074 A 5/1999

* cited by examiner

*Primary Examiner*—Jeffrey Donels
(74) *Attorney, Agent, or Firm*—Rossi, Kimms & McDowell LLP

(57) ABSTRACT

An arpeggio playing apparatus comprises a musical tone signal generating device including a plurality of arpeggio playing parts, or an automatic music playing device and at least one arpeggio playing part. The arpeggio playing part is capable of playing an automatic arpeggio with an arpeggio pattern at a progression tempo. Under the condition that one of the arpeggio playing parts or the automatic music playing device has started playing an automatic arpeggio or an automatic music performance at the progression tempo which defines a synchronization timing consisting of periodically aligned synchronization grids, when a start instruction for a new arpeggio playing part is received, the new arpeggio playing part starts the operation in synchronism with the defined synchronization timing. If the start instruction comes at a time point within a delay margin, the arpeggio playing is started immediately and the first span of the arpeggio pattern is played in a shortened time length between the start instruction and the first coming synchronization grid. If the start instruction comes at a time point outside the delay margin, the start of the arpeggio playing is suspended until the first coming synchronization grid.

13 Claims, 14 Drawing Sheets

Arrangement of Tone Processing Parts (Ex. 1)

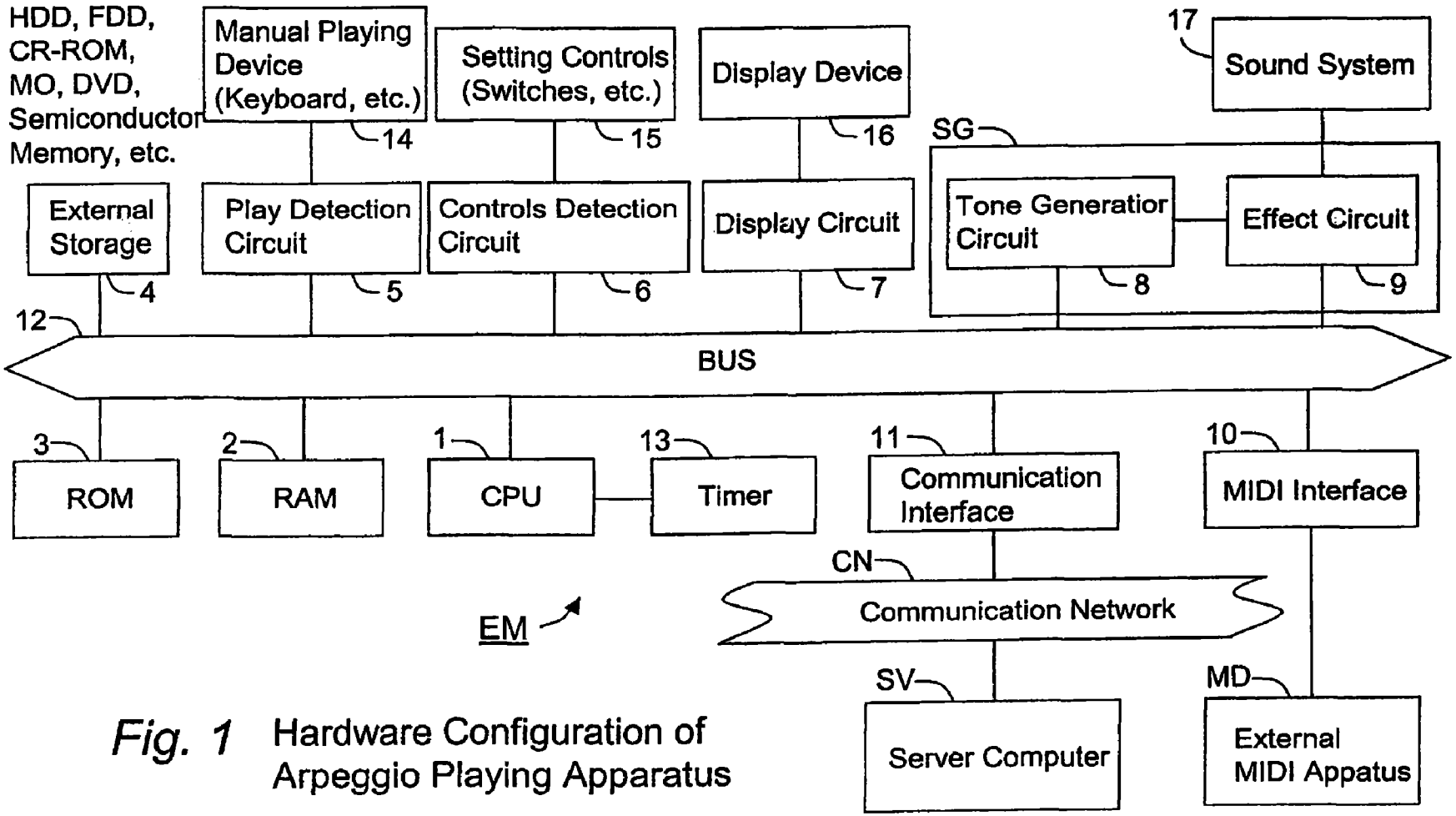
*Fig. 1* Hardware Configuration of Arpeggio Playing Apparatus

*Fig. 2* Arrangement of Tone Processing Parts (Ex. 1)
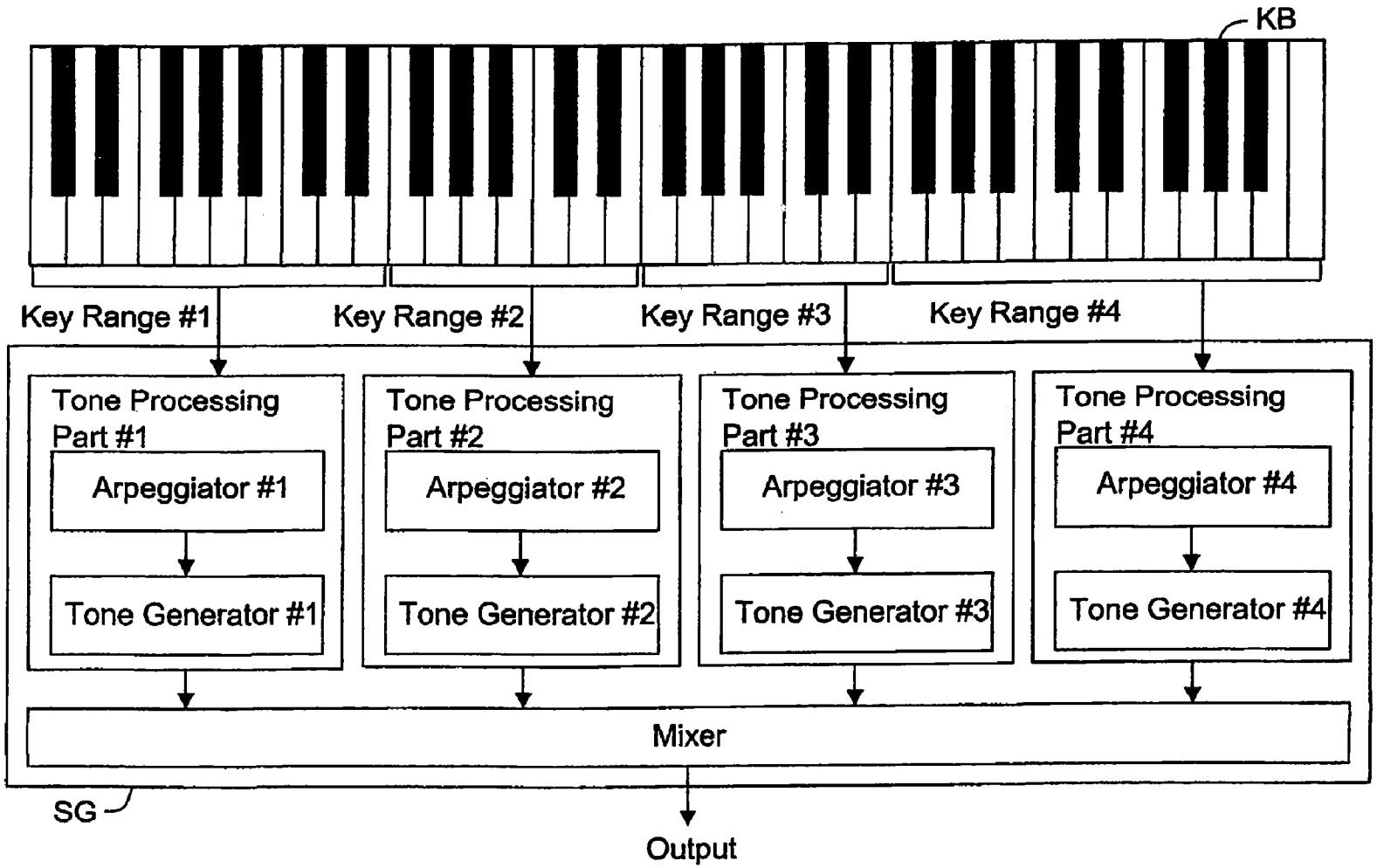

*Fig. 3* Track Structure of Arpeggio Patterns
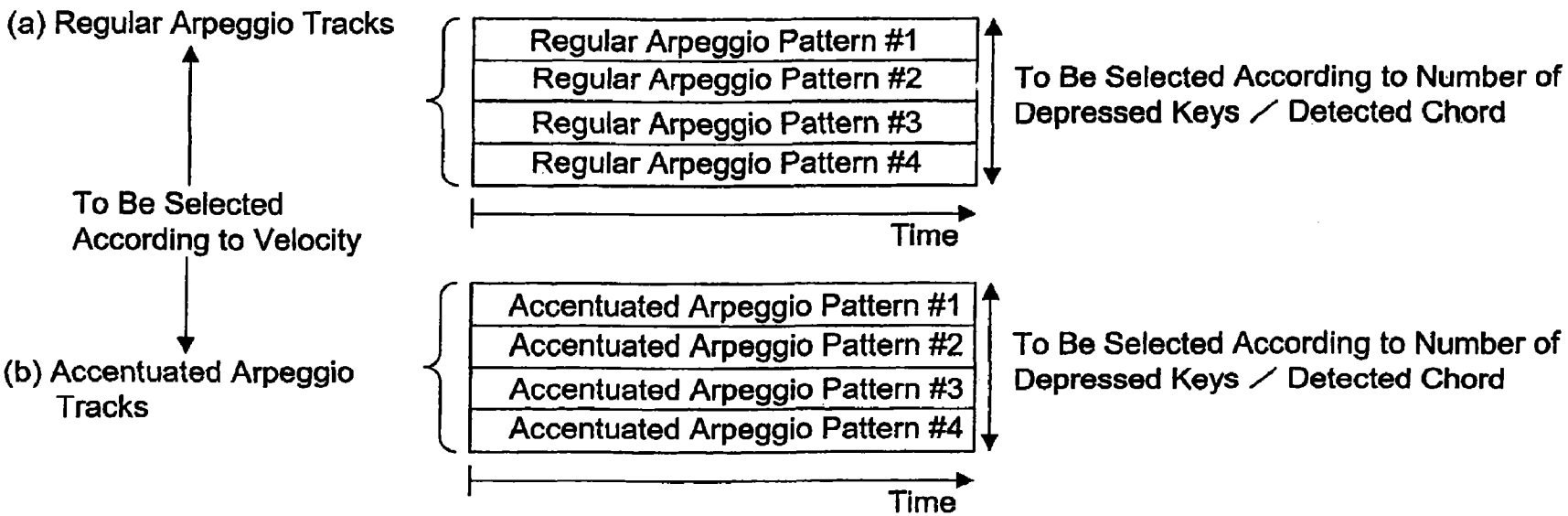

*Fig. 4* Arpeggio Start Timing
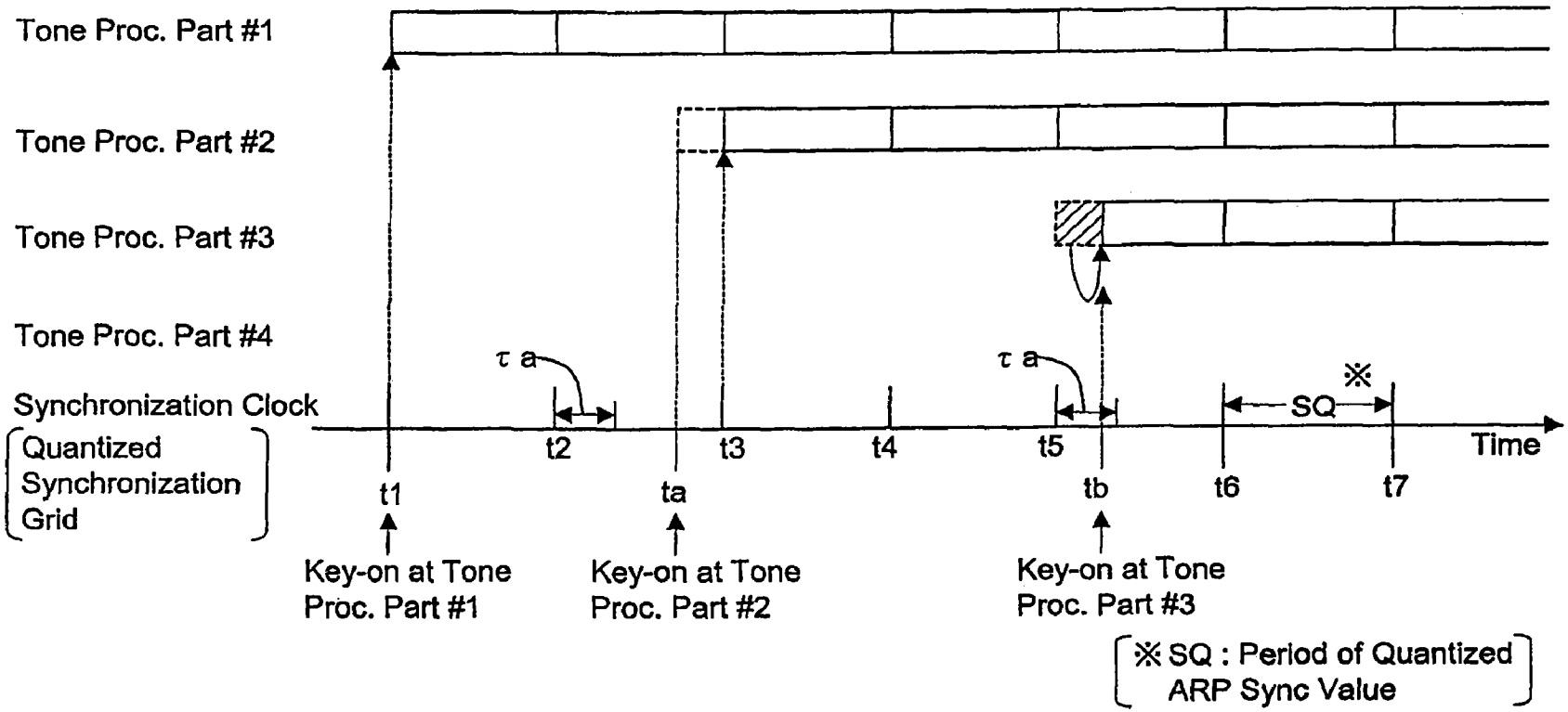

*Fig. 5* Changing Over Arpeggio Patterns
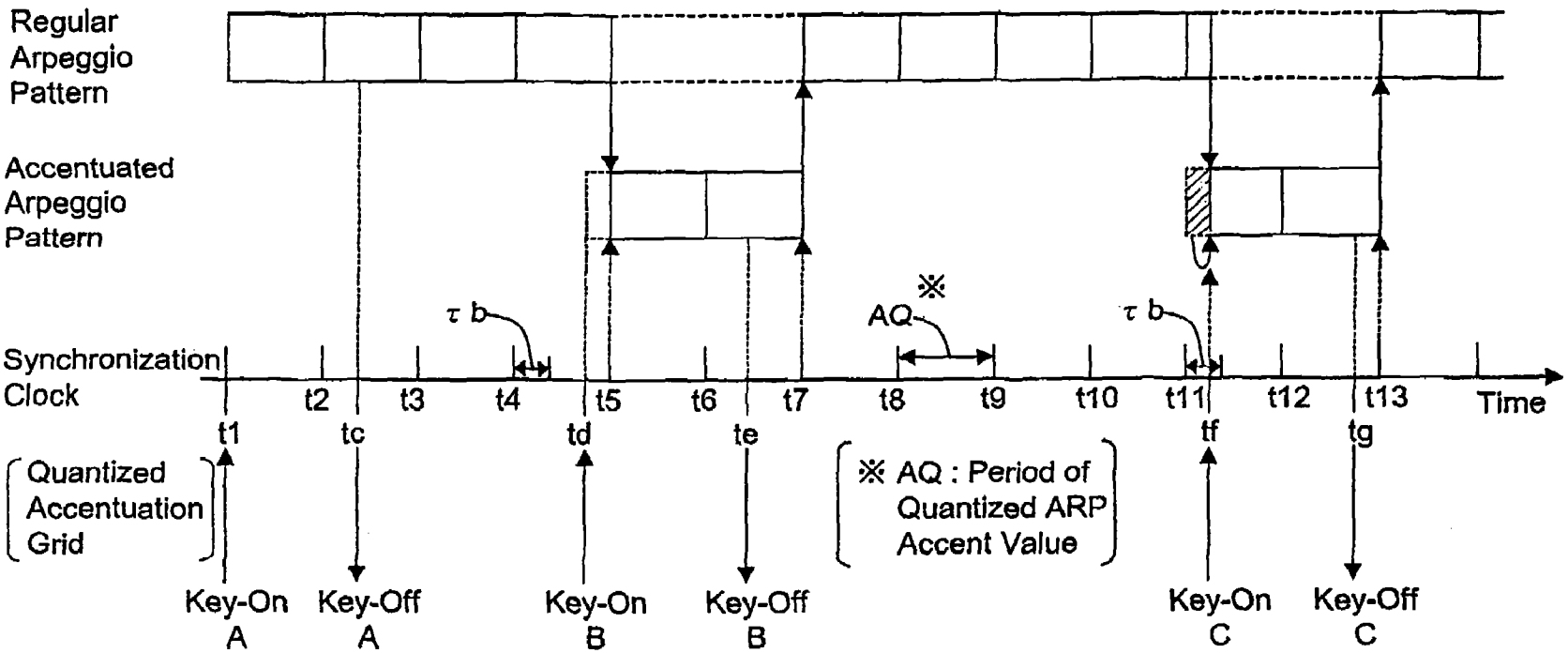

*Fig. 6a* Key-On Processing (Part 1)
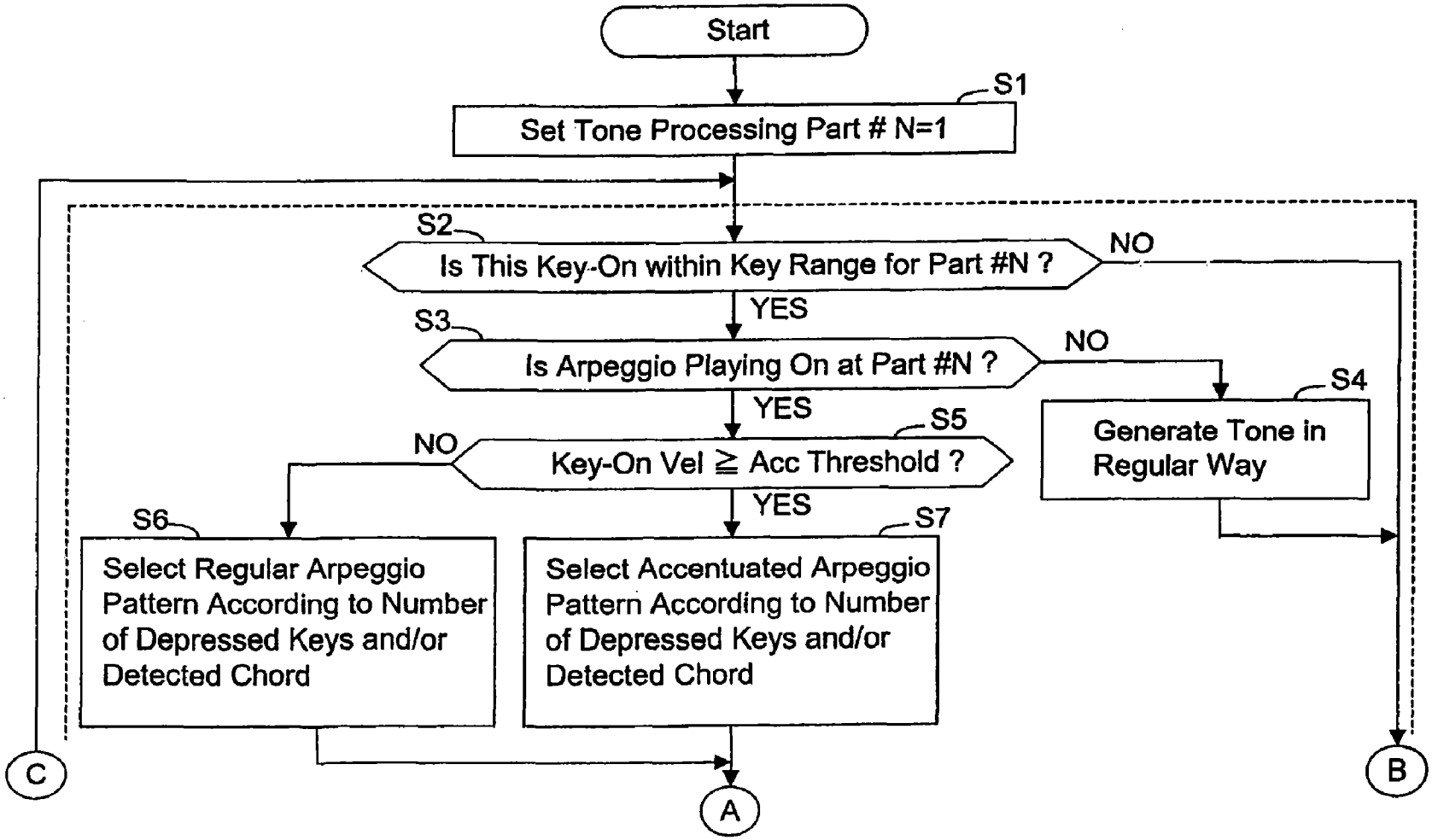

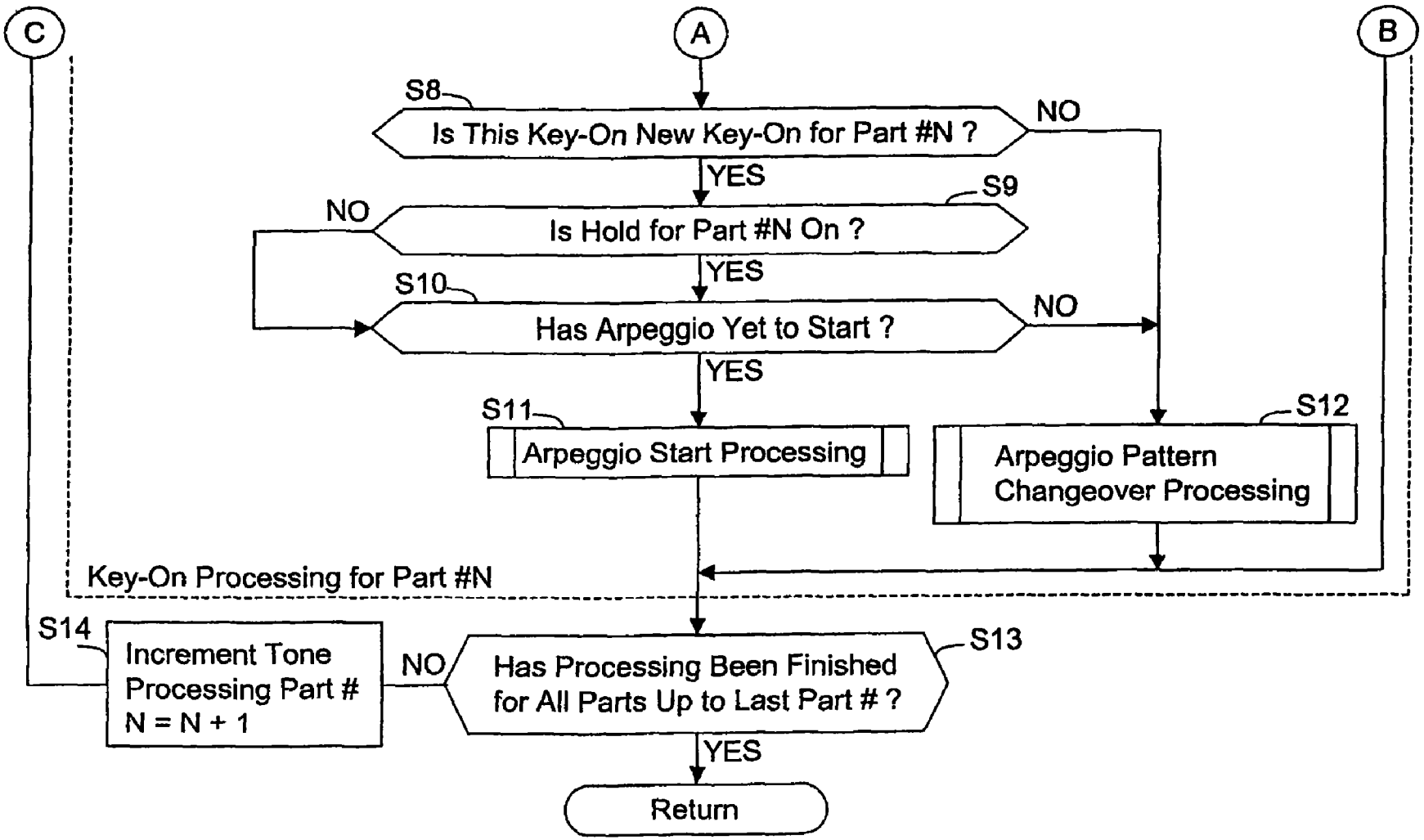
*Fig. 6b* Key-On Processing (Part 2)

*Fig. 7* Arpeggio Start Processing
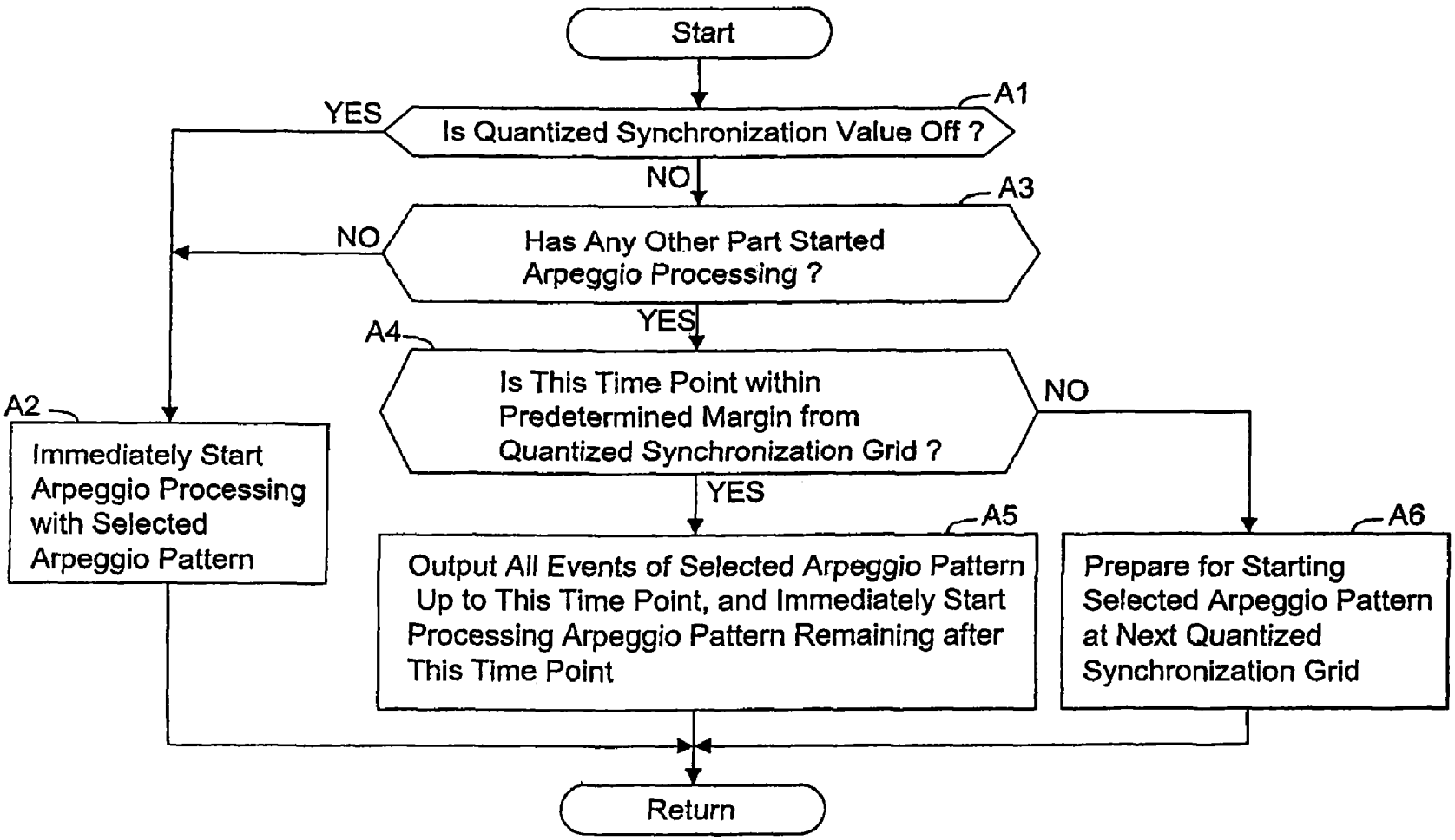

*Fig. 8* Arpeggio Pattern Changeover Processing
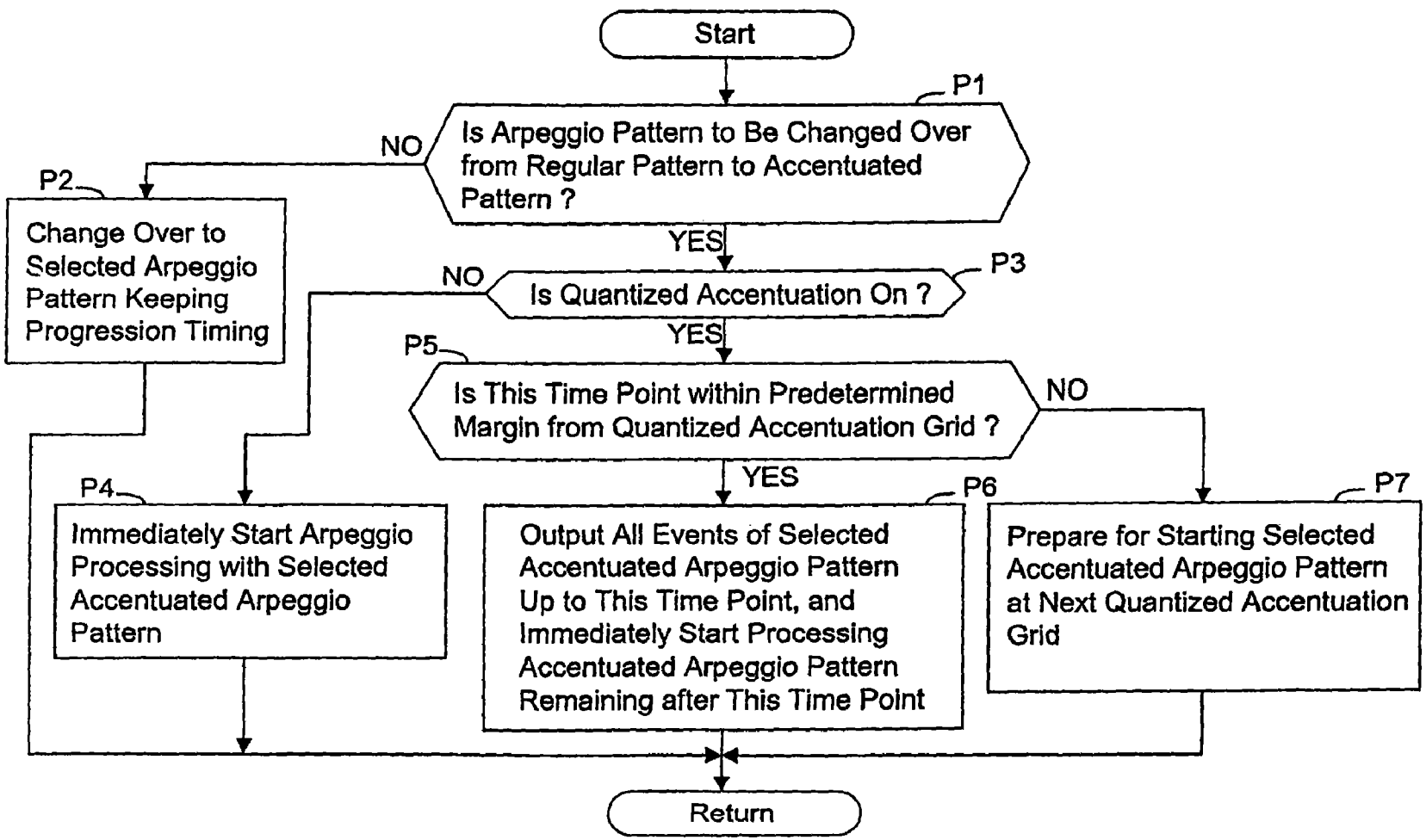

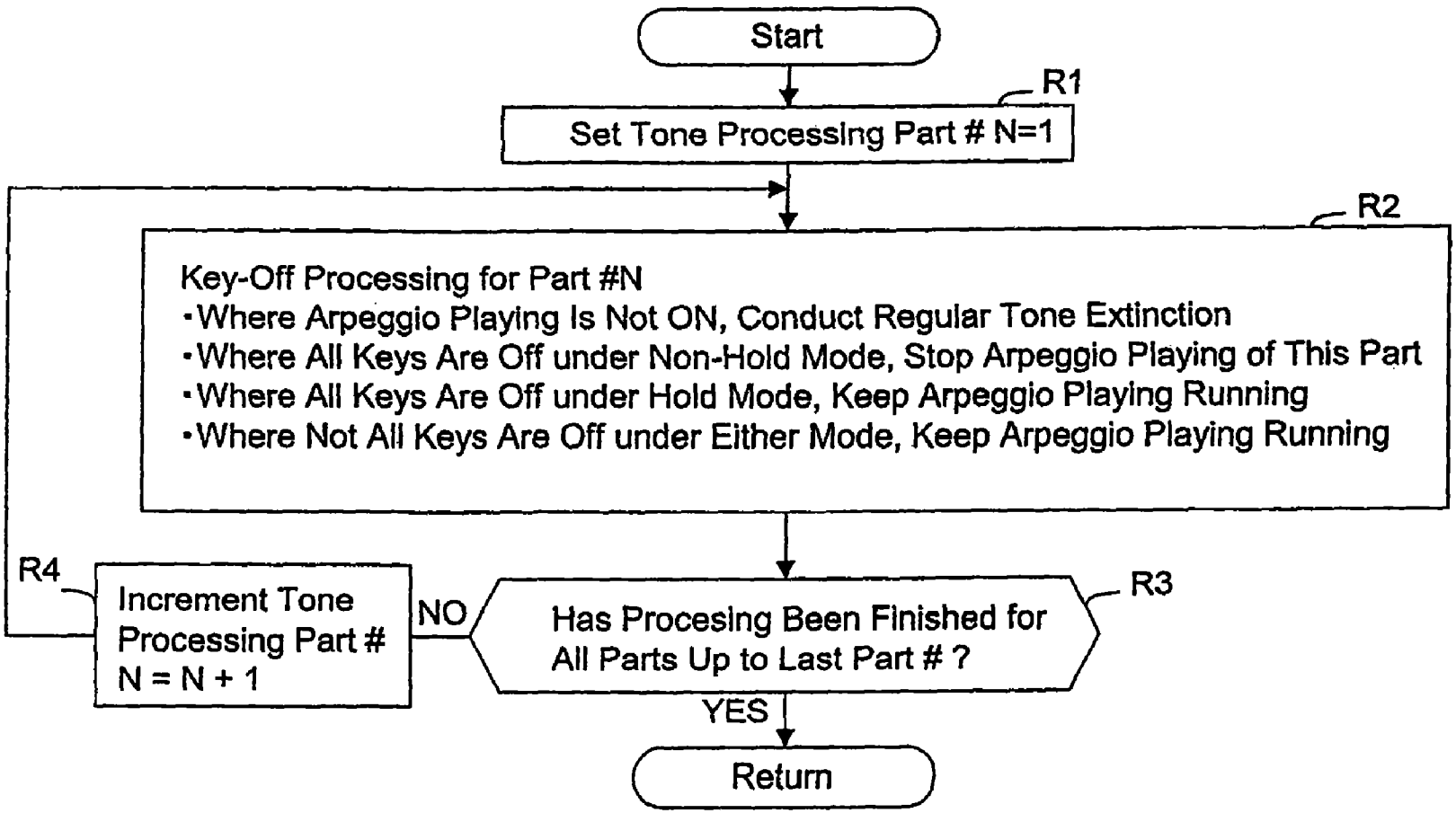
*Fig. 9* Key-Off Processing

*Fig. 10a* Time Length Adjustment of Arpeggio Pattern by Uniformly Shortening Whole Pattern Up to Next Synchronization Time
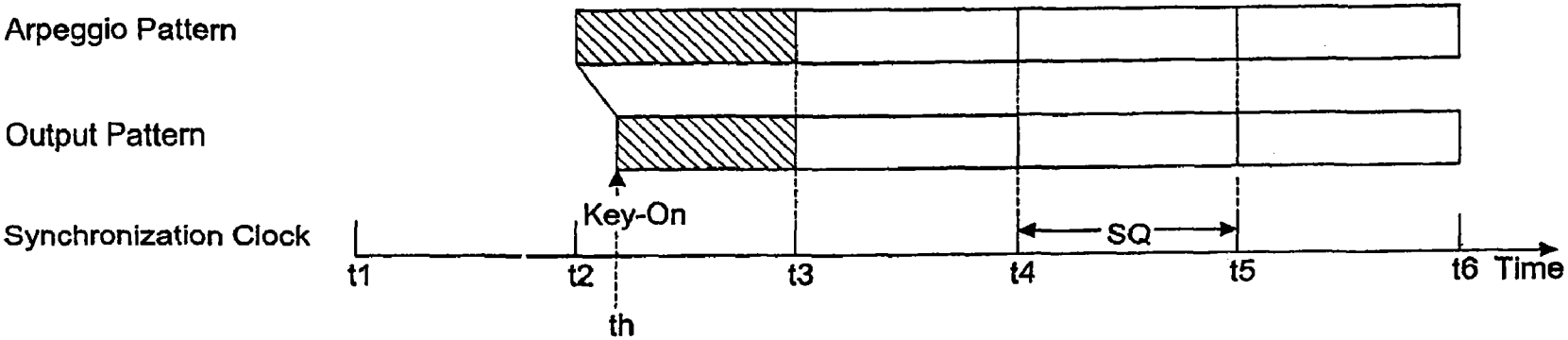
*Fig. 10b* Time Length Adjustment of Arpeggio Pattern by Locally Elongating Head Portion of Pattern
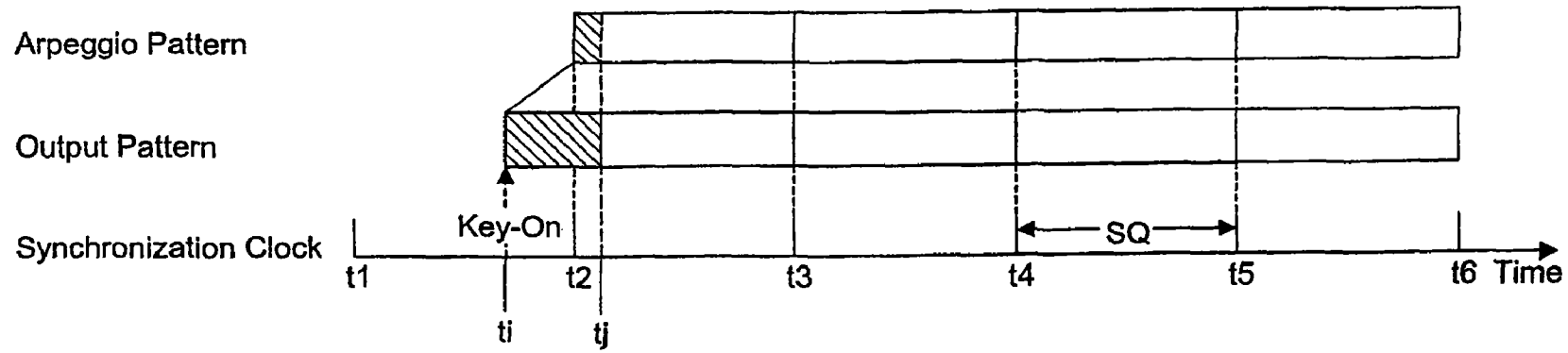

*Fig. 10c* Time Length Adjustment of Arpeggio Pattern by Uniformly Elongating Whole Pattern Up to Second Coming Synchronization Time
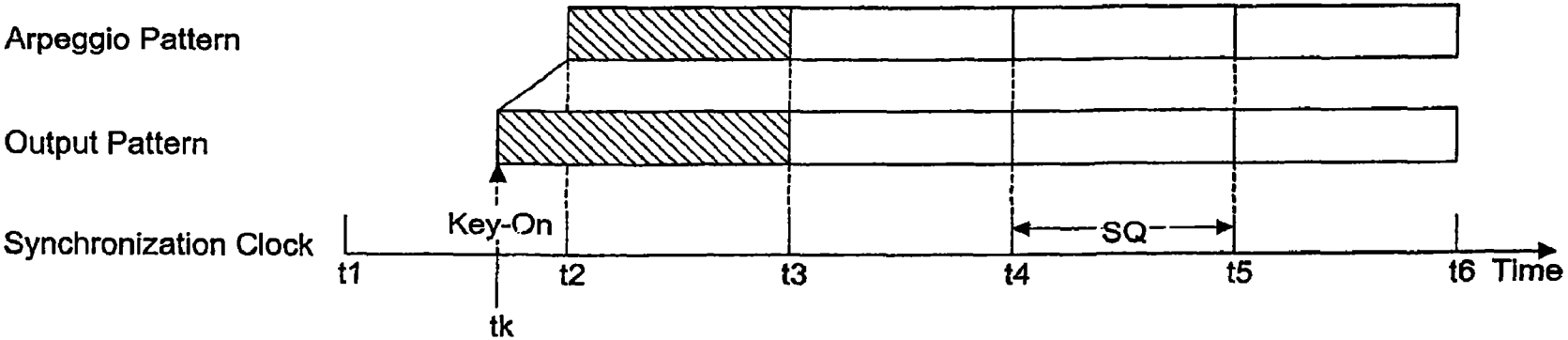

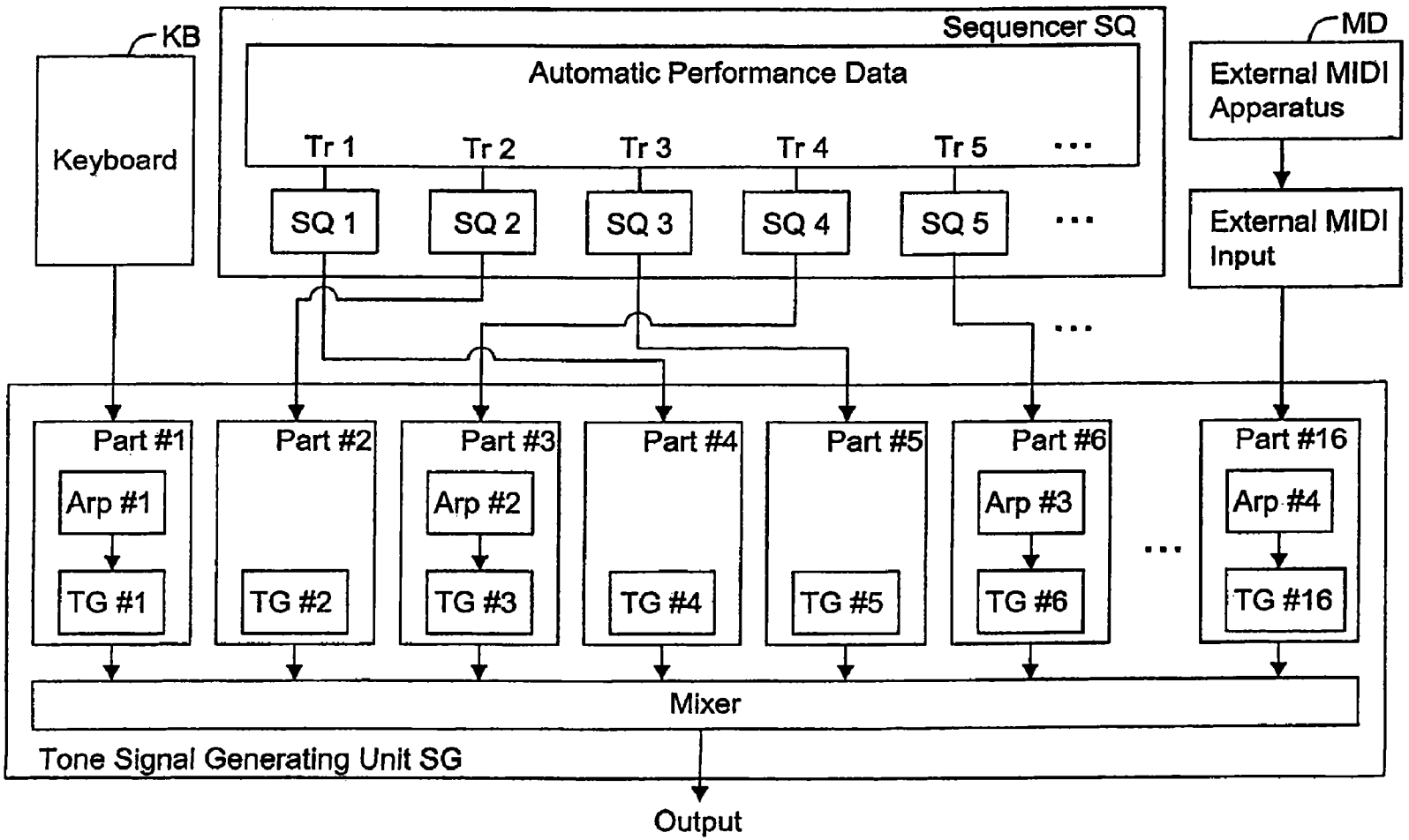
Fig. 11 Arrangement of Tone Processing Parts (Ex. 2)

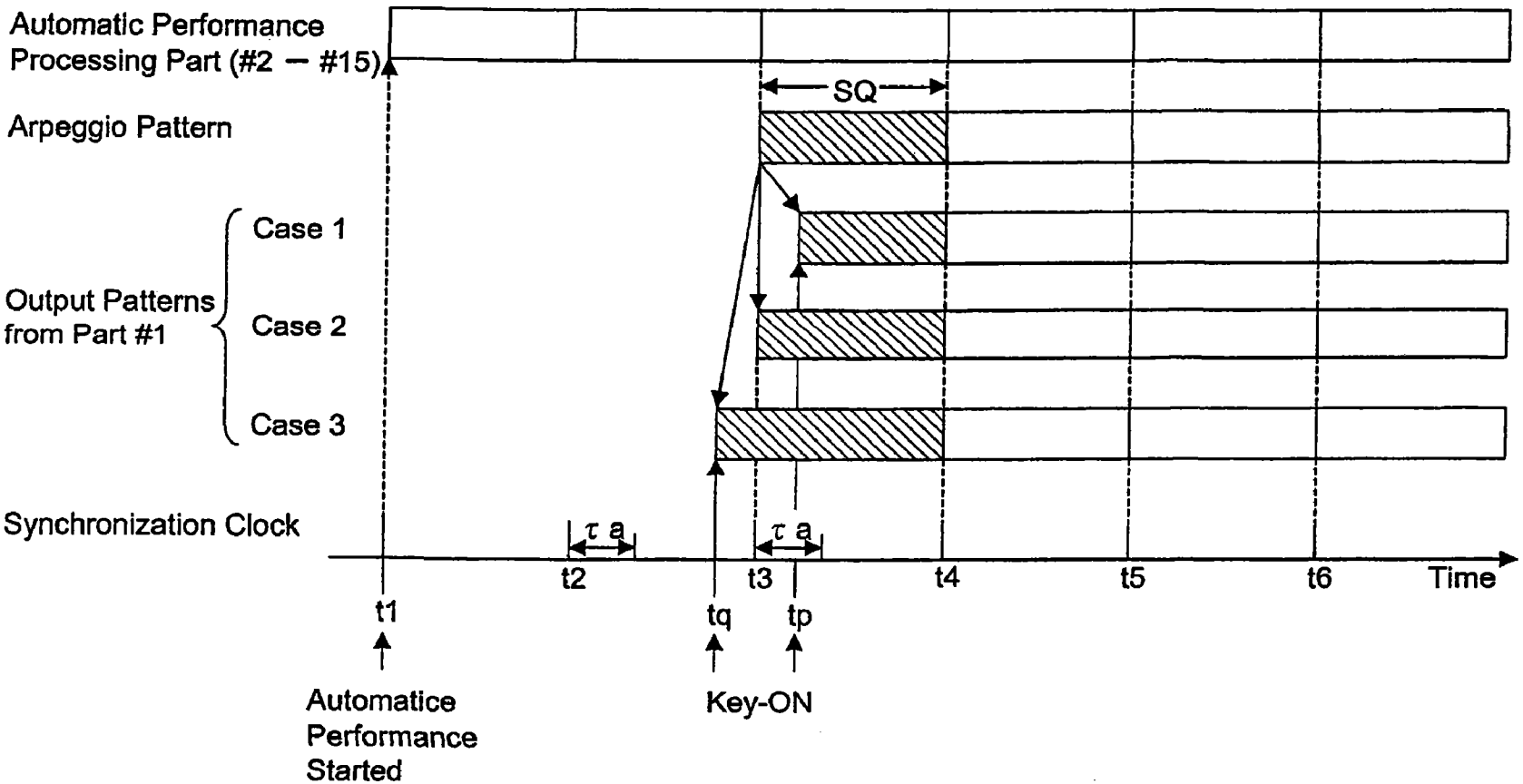
*Fig. 12* Arpeggio Start Timing

APPARATUS AND COMPUTER PROGRAM FOR PLAYING ARPEGGIO

TECHNICAL FIELD

The present invention relates to an apparatus for playing arpeggios and a computer program therefor, and more particularly to an electronic musical apparatus for automatically running a plurality of arpeggio performances in parallel in rhythmic synchronization with each other or with another automatic musical performance.

BACKGROUND INFORMATION

Various types of musical apparatuses are conventionally known in the art for automatically playing arpeggios in response to simple manual playing operations by the player on the keyboard. An example of automatic arpeggio playing apparatus is disclosed in U.S. Pat. No. 6,051,771 (corresponding to unexamined Japanese patent publication No. H11-126074) in which as the player designates a chord on the keyboard, the apparatus generates the chord constituent notes in succession as a broken chord based on a pre-stored arpeggio pattern.

In the above-referenced publication, a particular part of the keyboard is allotted for the arpeggio playing (i.e. an arpeggio key range), and a chord played by depressing the keys in the arpeggio key range is produced with successive generation of the chord constituent notes in an arpeggio pattern which is selected from among a plurality of pre-stored arpeggio patterns. However, this arpeggio playing apparatus is not adapted for playing arpeggios (i.e. broken chords) in different patterns respectively in response to different chords played in different key ranges.

A conventional arpeggio playing apparatus may be provided with a plurality of arpeggio playing mechanisms (or units) so that different chords played in the different key ranges would produce broken chords with different arpeggio patterns, respectively. However, an arpeggio playing apparatus generally starts reading out an arpeggio pattern to start a broken chord performance in response to key depressions (new key-ons detected) in the arpeggio key range, and stops reading out the arpeggio pattern when the depressed keys have all been released, although there can be different operations depending on the operation modes. Under such a circumstance, if the reading out operations of arpeggio patterns start independently at the different key ranges, the arpeggio patterns for playing arpeggios may run without being synchronized (i.e. under staggered rhythm beatings) with each other. The phenomenon of staggered rhythm beatings can occur similarly in the case where an arpeggio performance is conducted while other automatic performances such as an automatic rhythm performance and an automatic melody performance are running.

SUMMARY OF THE INVENTION

In view of the foregoing circumstances, therefore, it is a primary object of the present invention to provide an arpeggio playing apparatus and a computer program therefor with which arpeggio performances by a plurality of arpeggio playing units will not deviate from each other in rhythm beating, and further an arpeggio pattern will start with a favorable manner in view of another already running arpeggio performance or automatic performance (e.g. an accompaniment or a melody) in terms of a synchronized musical progression.

According to the present invention, the object is accomplished by providing an arpeggio playing apparatus comprising: a musical tone signal generating device including a plurality of arpeggio playing parts each of which is capable of playing an automatic arpeggio with an arpeggio pattern at a progression tempo, the operation of the arpeggio playing part being started in response to a start instruction; a start instruction detecting device that detects a start instruction for an arpeggio playing part to start the operation; and a start controlling device that controls, under the condition that a first arpeggio playing part has started playing an automatic arpeggio at the progression tempo which defines a synchronization timing including synchronization grids and that a start instruction is received for another arpeggio playing part, the another arpeggio playing part to start the operation thereof in synchronism with the defined synchronization timing and to run at the progression tempo. Thus, plural automatic arpeggio performances by plural arpeggio playing parts will run in synchronism with each other, thereby preventing staggered progressions of arpeggio performances.

In an aspect of the present invention, the start controlling device may control the another arpeggio playing part to immediately start the operation upon receipt of the start instruction for the another arpeggio playing part in such a way that a span of the arpeggio pattern from its head until the position corresponding to a first coming synchronization grid is played in a shortened time length between the receipt of the start instruction and the first coming synchronization grid. This type of control may preferably be conducted when the time point at which the start instruction is received locates within a predetermined time range from a preceding synchronization grid that locates just before the start instruction. Thus, the later instructed arpeggio performance will start without a delay, with the existing time differences being absorbed at the beginning span of the arpeggio pattern by the first coming synchronization grid, thereafter keeping synchronized progressions of the arpeggio performances.

In another aspect of the present invention, the start controlling device may control the another arpeggio playing part to immediately start the operation upon receipt of the start instruction for the another arpeggio playing part in such a way that a span of the arpeggio pattern from its head until the position corresponding to a first coming synchronization grid is played in an elongated time length between the receipt of the start instruction and the second coming synchronization grid. This type of control may preferably be conducted when the time point at which the start instruction is received locates outside a predetermined time range from a preceding synchronization grid that locates just before the start instruction. Thus, the later instructed arpeggio performance will start without a delay, with the existing time differences being absorbed at the beginning span of the arpeggio pattern by the second coming synchronization grid, thereafter keeping synchronized progressions of the arpeggio performances.

In a further aspect of the present invention, when the time point at which the start instruction is received locates outside a predetermined time range from a preceding synchronization grid that locates just before the start instruction, the start controlling device may control the another arpeggio playing part to suspend starting until the first coming synchronization grid and to start the operation at the first coming synchronization grid in such a way that a span of the arpeggio pattern from its head until the position corresponding to a first coming synchronization grid is played in the time length between the first coming synchronization grid and the second coming synchronization grid. Thus, the later instructed arpeggio performance will start with the full arpeggio pattern at the correct tempo and run in synchronism with the earlier started and currently running arpeggio performance.

According to the present invention, the object is further accomplished by providing an arpeggio playing apparatus comprising: a musical tone signal generating device including an automatic music playing device and an arpeggio playing part that is capable of playing an automatic arpeggio with an arpeggio pattern at a progression tempo, the operation of the arpeggio playing part being started in response to a start instruction; a start instruction detecting device that detects a start instruction for the arpeggio playing part to start the operation; and a start controlling device that controls, under the condition that the automatic music playing device has started an automatic music performance at the progression tempo which defines a synchronization timing including synchronization grids and that a start instruction is received for the arpeggio playing part, the arpeggio playing part to start the operation thereof in synchronism with the defined synchronization timing and to run at the tempo of the automatic music playing device. Thus, the automatic arpeggio performance will run in synchronism with the automatic music performance, thereby preventing staggered progression between the automatic performances.

In a still further aspect of the present invention, the start controlling device may control the arpeggio playing part to immediately start the operation upon receipt of the start instruction for the arpeggio playing part in such a way that a span of the arpeggio pattern from its head until the position corresponding to a first coming synchronization grid is played in a shortened time length between the receipt of the start instruction and the first coming synchronization grid. This type of control may preferably be conducted when the time point at which the start instruction is received locates within a predetermined time range from a preceding synchronization grid that locates just before the start instruction. Thus, the arpeggio performance will start without a delay, with the existing time differences being absorbed at the beginning span of the arpeggio pattern by the first coming synchronization grid, thereafter keeping a synchronized progression of the arpeggio performance with the automatic music performance.

In a still further aspect of the present invention, the start controlling device may control the arpeggio playing part to immediately start the operation upon receipt of the start instruction for the arpeggio playing part in such a way that a span of the arpeggio pattern from its head until the position corresponding to a first coming synchronization grid is played in an elongated time length between the receipt of the start instruction and the second coming synchronization grid. This type of control may preferably be conducted when the time point at which the start instruction is received locates outside a predetermined time range from a preceding synchronization grid that locates just before the start instruction. Thus, the arpeggio performance will start without a delay, with the existing time differences being absorbed at the beginning span of the arpeggio pattern by the second coming synchronization grid, thereafter keeping synchronized progressions of the arpeggio performance with the automatic music performance.

In a still further aspect of the present invention, when the time point at which the start instruction is received locates outside a predetermined time range from a preceding synchronization grid that locates just before the start instruction, the start controlling device may control the arpeggio playing part to suspend starting until the first coming synchronization grid and to start the operation at the first coming synchronization grid in such a way that a span of the arpeggio pattern from its head until the position corresponding to a first coming synchronization grid is played in the time length between the first coming synchronization grid and the second coming synchronization grid. Thus, the arpeggio performance will start with the full arpeggio pattern at the correct tempo and run in synchronism with the earlier started and currently running automatic music performance.

According to the present invention, the object is still further accomplished by providing a computer program for playing an automatic arpeggio with a computer comprising a musical tone signal generating device including a plurality of arpeggio playing parts each of which is capable of playing an automatic arpeggio with an arpeggio pattern at a progression tempo and functioning as an arpeggio playing apparatus, the program containing instructions for: detecting a start instruction for each of the arpeggio playing parts to start the operation; and controlling, under the condition that a first arpeggio playing part has started playing an automatic arpeggio at the progression tempo which defines a synchronization timing including synchronization grids and that a start instruction is received for another arpeggio playing part, the another arpeggio playing part to start the operation thereof in synchronism with the defined synchronization timing and to run at the progression tempo. Thus, plural automatic arpeggio performances by plural arpeggio playing parts will run in synchronism with each other, thereby preventing staggered progressions of arpeggio performances.

According to the present invention, the object is still further accomplished by providing a computer program for playing an automatic arpeggio with a computer comprising a musical tone signal generating device including an automatic music playing device and an arpeggio playing part that is capable of playing an automatic arpeggio with an arpeggio pattern at a progression tempo and functioning as an arpeggio playing apparatus, the program containing instructions for: detecting a start instruction for the arpeggio playing part to start the operation; and controlling, under the condition that the automatic music playing device has started playing an automatic music performance at the progression tempo which defines a synchronization timing including periodically aligned synchronization grids and that a start instruction is received for the arpeggio playing part, the arpeggio playing part to immediately start in synchronism with the defined synchronization timing the operation thereof upon receipt of the start instruction for the arpeggio playing part in such a way that a span of the arpeggio pattern from its head until the position corresponding to a first coming synchronization grid is played in a shortened time length between the receipt of the start instruction and the first coming synchronization grid, and thereafter the arpeggio pattern is played at the progression tempo. Thus, the arpeggio performance will start without a delay, with the existing time differences being absorbed at the beginning span of the arpeggio pattern by the first coming synchronization grid, thereafter keeping a synchronized progression of the arpeggio performance with the automatic music performance.

According to the present invention, the object is still further accomplished by providing a computer program for playing an automatic arpeggio with a computer comprising a musical tone signal generating device including an automatic music playing device and an arpeggio playing part that is capable of playing an automatic arpeggio with an arpeggio pattern at a progression tempo and functioning as an arpeggio playing apparatus, the program containing instructions for: detecting a start instruction for the arpeggio playing part to start the operation; and controlling, under the condition that the automatic music playing device has started an automatic music performance at the progression tempo which defines a synchronization timing including periodically aligned synchronization grids and that a start instruction is received for the arpeggio playing part, the arpeggio playing part to immediately start the operation thereof in synchronism with the defined synchronization timing upon receipt of the start instruction for the arpeggio playing part in such a way that a span of the arpeggio pattern from its head until the position corresponding to a first coming synchronization grid is played in an elongated time length between the receipt of the start instruction and the second coming synchronization grid, and thereafter the arpeggio pattern is played at the progression tempo. Thus, the arpeggio performance will start without a delay, with the existing time differences being absorbed at the beginning span of the arpeggio pattern by the second coming synchronization grid, thereafter keeping synchronized progressions of the arpeggio performance with the automatic music performance.

As will be apparent from the above description, the present invention can be practiced not only in the form of an apparatus, but also in the form of a computer program to operate a computer or other data processing devices. The invention can further be practiced in the form of a method including the steps mentioned herein.

In addition, as will be apparent from the description herein later, some of the structural element devices of the present invention are structured by means of hardware circuits, while some are configured by a computer system performing the assigned functions according to the associated programs. The former may of course be configured by a computer system and the latter may of course be hardware structured discrete devices. Therefore, a hardware-structured device performing a certain function and a computer-configured arrangement performing the same function should be considered a same-named device or an equivalent to each other.

The invention and its various embodiments can now be better understood by turning to the following detailed description of the preferred embodiments which are presented as illustrated examples of the invention defined in the claims. It is expressly understood that the invention as defined by the claims may be broader than the illustrated embodiments described bellow.

BRIEF DESCRIPTION OF THE DRAWINGS

For a better understanding of the present invention, and to show how the same may be practiced and will work, reference will now be made, by way of example, to the accompanying drawings, in which:

FIG. 1 is a block diagram showing a hardware configuration of an arpeggio playing apparatus according to an embodiment of the present invention;

FIG. 2 is a block diagram showing an arrangement of tone processing parts in association with a manual keyboard according to an embodiment of the present invention;

FIG. 3 is a chart showing an example of a track structure of arpeggio patterns according to an embodiment of the present invention;

FIG. 4 is a timing chart showing examples of the starting times of the tone processing parts to run arpeggio playing according to an embodiment of the present invention;

FIG. 5 is a timing chart showing an example of the changeover use between a regular arpeggio pattern and an accentuated arpeggio pattern according to an embodiment of the present invention;

FIGS. 6*a* and 6*b* are, in combination, a flow chart showing the procedure of a key-on processing with an embodiment of an arpeggio playing apparatus according to the present invention;

FIG. 7 is a flow chart showing the procedure of an arpeggio start processing with an embodiment of an arpeggio playing apparatus according to the present invention;

FIG. 8 is a flow chart showing the procedure of an arpeggio pattern changeover processing with an embodiment of an arpeggio playing apparatus according to the present invention;

FIG. 9 is a flow chart showing the procedure of a key-off processing with an embodiment of an arpeggio playing apparatus according to the present invention;

FIG. 10*a* is a timing chart showing an example of the time length adjustment of an arpeggio pattern with an embodiment of an arpeggio playing apparatus according to the present invention;

FIG. 10*b* is a timing chart showing another example of the time length adjustment of an arpeggio pattern with an embodiment of an arpeggio playing apparatus according to the present invention;

FIG. 10*c* is a timing chart showing a further example of the time length adjustment of an arpeggio pattern with an embodiment of an arpeggio playing apparatus according to the present invention;

FIG. 11 is a block diagram showing an arrangement of tone processing parts in association with a manual keyboard and an automatic performance processor according to another embodiment of the present invention; and FIG. 12 is a timing chart showing examples of the starting time of the arpeggio playing for the manual keyboard relative to the progression of an automatic performance with an embodiment of an arpeggio playing apparatus according to the present invention.

DETAILED DESCRIPTION OF EMBODIMENTS OF THE INVENTION

The present invention will now be described in detail with reference to the drawings showing preferred embodiments thereof. It should, however, be understood that the illustrated embodiments are merely examples for the purpose of understanding the invention, and should not be taken as limiting the scope of the invention.

Overall System Configuration

FIG. 1 shows a block diagram illustrating the overall hardware configuration of an arpeggio playing apparatus or system according to an embodiment of the present invention. An arpeggio playing apparatus EM is a kind of computer which performs the function of musical data processing based on player's manual operations as an electronic musical instrument performs, and comprises a central processing unit (CPU) 1, a random access memory (RAM) 2, a read-only memory (ROM) 3, an external storage device 4, a play detection circuit 5, a controls detection circuit 6, a display circuit 7, a tone generator circuit 8, an effect circuit 9, a MIDI interface 10 and a communication interface 11, all of which are connected with each other by a system bus 12.

The CPU 1 functions as a data processing unit in association with the RAM 2 and the ROM 3, and conducts various musical data processing including arpeggio playing processing driven by a clock signal from a timer 13, and also functions as a sequencer (SQ) to conduct an automatic musical performance according to automatic performance data. The RAM 2 is used as work areas for temporarily store various data necessary for the processing. The ROM 3 stores beforehand various control programs including the arpeggio playing program and data prepared for automatic musical performances in order to execute the above-mentioned processing.

The external storage device 4 may include a built-in storage medium such as a hard disk (HD) and a flash memory (semiconductor memory) as well as various portable external storage media such as a compact disk read-only memory (CD-ROM), a flexible disk (FD), a magneto-optical (MO) disk, a digital versatile disk (DVD), a small-sized memory card like Smart Media (trademark) and so forth. Thus, the arpeggio playing apparatus can process various data including automatic performance data stored in any type of external storage device 4.

The play detection circuit 5 detects the user's real-time operations of a manual playing device 14 such as a keyboard (as to which key is depressed with what intensity or velocity and which key is released) and sends the corresponding manual performance data of the real-time operations (representing the key-on event including the note number and the key-on velocity and the key-off event including the note number) to the data processing unit, while the controls detection circuit 6 detects the user's operations of the setting controls 15 (on a control panel) such as key switches and sends the corresponding setting data to the data processing unit. Among the setting controls 15 are further included, for example, arpeggio parameter setting controls relating to arpeggio playing such as an arpeggio tempo, and arpeggio on/off command, a quantization value and a hold command for each of arpeggio playing parts.

The display circuit 7 is connected to a display device 16 such as an LCD for displaying various screen images and pictures and to various indicators (not shown), and controls the displayed contents and lighting conditions of these devices according to instructions from the CPU 1, and also presents GUIs for assisting the user in operating the various setting controls 15 and the manual playing device 14.

The tone generator circuit 8 and the effect circuit 9 constitute a musical tone signal generating unit SG (or simply called a tone generating unit) including a plurality of tone processing parts. The tone generator circuit 8, therefore, comprises a plurality of tone generators (#1-#4), each including a plurality of tone generation channels, and an arpeggio pattern memory. Each of the tone processing parts is arranged so that a desired tone color can be set, and is provided with a function of an arpeggiator. Each of the tone processing part produces tone signal data representing a tone waveform having a tone color as set for each tone processing part in response to performance data of the real-time manual performance or of the automatic performance derived from the play detection circuit 5 or from the memory 3 or the storage 4 via the sequencer SQ in the data processing unit and given to each tone processing part, and, where the function of the arpeggiator is rendered active, produces tone signal data for an arpeggio (a broken chord performance) according to an arpeggio pattern selected and read out from the arpeggio pattern memory. The tone generator in each tone processing part may be a physical independent dedicated tone generator or one of the logically divided portions of a physically single tone processing circuit. The effect circuit 9 includes an effect imparting DSP (digital signal processor) and imparts intended tone effects to the tone signal data of each tone processing part to produce musical tone signals for the plurality of tone processing parts. To the effect circuit 9 is connected a sound system 17, which includes a D/A converter, an amplifier and a loudspeaker, and emits audible musical sounds based on the effect imparted musical tone signals from the tone generating unit SG.

To the MIDI interface 10 is connected another MIDI apparatus MD so that MIDI musical performance data are received from another apparatus MD and are used in this arpeggio playing apparatus EM. For example, the tone generating unit SG can produce tone signals based on the performance data supplied from another apparatus MD. The communication interface 11 is connected to a communication network CN such as the Internet and a local area network (LAN) so that a control program and various data can be downloaded from an external server computer SV or the like, and can be stored in the external storage 4 for later use in this system.

General Operation of Arpeggio Playing

In the arpeggio playing apparatus according to an embodiment of the present invention, the musical tone signal generating unit (tone generating unit) SG comprises a plurality of tone signal processing parts, which may be referred to as "tone processing parts," so that the plurality of tone processing parts can execute plural arpeggio performances in parallel where each of the tone processing parts include an arpeggiator. FIG. 2 shows an example #1 of an arrangement of the tone processing parts in association with a manual keyboard KB according to an embodiment of the present invention. In this example, the musical tone signal generating unit (tone generating unit) SG comprises four tone processing parts #1-#4, and the tone signals generated by these four processing parts #1-#4 are mixed at a mixer and outputted to the sound system 17 (FIG. 1).

The tone processing parts #1-#4 include tone generators #1-#4, respectively, each of which can separately set the tone color as well as the key range to receive performance data (note-on data and note-off data) from the manual playing device 14 such as a keyboard KB. In the example shown in FIG. 2, the keyboard KB is divided into four key ranges #1-#4 and the performance data from the respective key ranges #1-#4 are received by the respective tone processing parts #1-#4. The key ranges to be taken charge of by the respective tone processing parts may be overlapped so that a single note-on event (or key-on event) will cause the tone generation by two or more tone processing parts.

The tone processing parts #1-#4 include arpeggiator #1-#4, respectively, each of which has a function of automatically playing an arpeggio (broken chord) by producing tone signals to be sounded in succession along a selected arpeggio pattern based the performance data derived from the keyboard KB (manual playing device). In this context, the "tone processing part" can be termed as an "arpeggio processing part." The musical tone signal generating unit (tone generating unit) SG includes an arpeggio pattern memory which stores various arpeggio patterns so that a desired arpeggio pattern can be selected from among the plurality of arpeggio patterns according to the user's selecting operation for each of the tone processing parts, whereby arpeggio patterns can be independently set for the respective tone processing parts and a plurality of arpeggios will be performed concurrently (in parallel) using the plurality of tone processing parts.

Each of the arpeggiators #1-#4 has a function of accentuating (enhancing or highlighting) the arpeggio performance, for which there are provided a regular arpeggio track and an accentuated arpeggio track for each of the arpeggio patterns, wherein a running arpeggio pattern will be changed over from the regular arpeggio pattern in the regular arpeggio track to the accentuated arpeggio pattern in the accentuated arpeggio track when the key-on velocity is equal to or greater than the predetermined threshold value, thereby enhancing the arpeggio playing.

FIG. 3 shows an example of a track structure of arpeggio patterns according to an embodiment of the present invention.

The illustrated example has four regular arpeggio tracks (a) respectively storing regular arpeggio patterns #1-#4 and four accentuated arpeggio tracks (b) respectively storing accentuated arpeggio patterns #1-#4, the same pattern #s corresponding to each other. The arpeggio pattern #s are selected (determined) according to the number of depressed keys in the keyboard KB and/or the chord detected based on the depressed keys in the keyboard KB. The regular arpeggio track or the accentuated arpeggio track is to be selected according to whether the key-on velocity (Vel) of the depressed key or keys in the keyboard KB is less than the predetermined threshold value termed "Ace Threshold" or not.

An arpeggio pattern represents a pattern of notes sounding in succession in terms of rhythm and pitch with respect to the time progression, and has a length which is an integer multiple of the periods SQ and AQ (to be defined hereinafter) which respectively correspond to the span of a quantized synchronization grids and the span of a quantized accentuation grids (both to be described hereinafter). Shown exemplarily in FIG. 3, the regular arpeggio patterns on the regular arpeggio tracks are of a same length and the accentuated arpeggio patterns on the accentuated arpeggio tracks are also of another same length. However, the four arpeggio patterns on the regular arpeggio tracks may be different in length from each other, and the four arpeggio patterns on the accentuated arpeggio tracks may also be different in length from each other. Further, the pattern length on the regular arpeggio tracks may be longer than the pattern length on the accentuated arpeggio track as shown in FIG. 3, but the former length may be shorter than the latter or the both may be equal.

Typically, the pattern length on the regular tracks is between one measure and several measures, while the pattern length on the accentuated tracks is between one beat and one measure. The contents of the accentuated arpeggio patterns may preferably be of musically enhanced or highlighted ones than those of the regular arpeggio patterns, for example, larger in volume, greater in number of notes, more complicated in rhythm, and so forth.

While there are various parameters with respect to the arpeggiator, some typical parameters concerning the arpeggio playing processing are as follows.

(1) Parameters Common to All the Processing Parts

ARP Tempo: This indicates a tempo value for an arpeggio playing.

Quantized ARP Sync Value: This indicates whether or not a new arpeggio pattern is to be started in synchronism with an already running arpeggio performance or automatic performance, and in case of "yes," a quantized synchronization value. For example, in case of starting without synchronization, this value assumes zero (meaning "off"), and in case of synchronized starting, this value assumes a quantized synchronization value which can be equal to the note duration of a thirty-second, a twenty-fourth (corresponding to a sixteenth triplet), a sixteenth, a twelfth (corresponding to an eighth triplet), an eighth, a sixth (corresponding to a quarter triplet), or a quarter of the whole note duration.

(2) Parameters for Each of the Processing Parts

ARP Switch: This indicates on/off of the arpeggio playing.

ARP Hold Switch: This indicates on/off of the arpeggio playing hold operation.

ARP Bank/Category/Type: This identifies or designates an arpeggio pattern from among a plurality of arpeggio patterns prepared as hierarchically classified in terms of a bank, a category and a type.

ARP Accent Vel Threshold (abbreviated as AccThreshold): This indicates a threshold value of the velocity for determining the changeover from a regular arpeggio pattern to an accentuated arpeggio pattern.

Quantized ARP Accent Start: This indicates whether or not the quantization is applied in starting an accentuated arpeggio pattern, i.e. whether or not the accentuated pattern should be started in synchronism with the running regular arpeggio pattern.

Quantized ARP Accent Value: This value determines the timing of the quantized accentuation grids which serves as the synchronization timing for changing over the accentuated arpeggio patterns. The values are set adequately for the individual arpeggio patterns.

Start Timing Control of Arpeggio Playing

An embodiment of the present invention is adapted to play a plurality of arpeggio performances in parallel using a plurality of arpeggio processing parts (i.e. tone processing parts), wherein when a new key-on event occurs in a key range associated with an arpeggio processing part to start an arpeggio playing in this arpeggio processing part, the arpeggio processing part will start, at a quantized synchronization grid (i.e. timing), the designated arpeggio playing in synchronism with another arpeggio playing, if any, which is already running in another arpeggio processing part. If the occurrence of a new key-on is within a predetermined delay margin (tolerable time range for delay) from the synchronization timing, the arpeggio playing will start immediately. In this context, a new key-on is defined as a first occurrence of a key depression under the condition that all the keys have been released in the key range assigned to the arpeggio processing part in question. Where the "hold" mode is set "on" for the arpeggio processing part in question, a first new key-on starts an arpeggio playing in this arpeggio processing part, and the arpeggio playing will be kept running until the hold mode for this processing part is canceled (or turned off) by the user manipulating the setting control 15 (FIG. 1), even though all the depressed keys in this key range have been released ("all-key-off" condition). In this connection, where the hold mode is "on," a new key-on is only the very first new key-on in the key range, whereas where the hold mode is "off," every new key-on in the key range is a new key-on to start an arpeggio playing, which in turn will stop when an "all-key-off" condition occurs.

FIG. 4 illustrates examples of how the arpeggio patterns are started by the plurality of arpeggio processing parts (tone processing parts) according to an embodiment of the present invention. When there is a new key-on in any of the processing parts while no processing part is running an arpeggio playing, for example, when there is a new key-on in the processing part #1 at the time point t1 as shown in FIG. 4, the processing part #1 starts at "t1" an arpeggio playing with an arpeggio pattern (identified by ARP Bank/Category/Type) set for the processing part #1 at the set progression tempo (ARP Tempo). Where the Quantized ARP Sync Value is set at a certain definite value (one of a thirty-second, a twenty-fourth, . . . , a quarter note duration) other than zero (off), the quantized synchronization grids are set periodically aligned along with the time progression of the processing part #1 to define the synchronization timing for the automatic progression (or repetitions) of the arpeggio pattern. In FIG. 4, the synchronization grids are marked (graduated) at t1, t2, t3, and so forth with a time span (period) of SQ, starting at the key-on time point t1 at the processing part #1.

When another key-on occurs in another processing part, this processing part starts playing an arpeggio pattern. If the ARP Quantized Sync Value is not zero, this second processing part is to start the arpeggio pattern as quantized to the timing of the quantization grids which are marked along the time axis according to the quantized Sync Value. Suppose, for example, as shown in FIG. 4, there are new key-ons in the processing parts #2 and #3 at the time points ta and tb, respectively, to designate the starts of the arpeggio patterns set in the processing parts #2 and #3, respectively, the arpeggio patterns are started as quantized at the time points t3 and t5 among the quantized synchronization grids (synchronization timing) determined by the non-zero value of the ARP Quantized Sync Value.

More specifically, with reference to FIG. 4, if the key-on time ta in the processing part #2 comes a bit earlier than the next coming quantized synchronization grid t3 (but exceeding a predetermined delay margin tau-a from the preceding synchronization grid t2), the processing part #2 waits until the synchronization grid t3 to start playing the arpeggio pattern.

On the other hand, if the key-on time tb in the processing part #3 occurs a bit later than the preceding quantized synchronization grid t5 and within the predetermined delay margin tau-a from the synchronization grid t5, the processing part #3 does not wait until the next coming synchronization grid t6 but immediately outputs all the note events existing in the head part (between t5 and tb) of the arpeggio pattern as if it had started at the synchronization grid t5 and keeps on playing the arpeggio pattern from the pattern position corresponding to the time tb and onward at the progression tempo. If the arpeggio performance should start at the next coming quantized synchronization grid t6 instead, the arpeggio performance would be different from the intention of the user (player), especially in the case of the quantization value of a long duration such as a quarter note duration.

The above-mentioned predetermined delay margin tau-a is not necessarily a 20 ms period but may be longer or shorter than 20 ms as long as it is shorter than the grid span SQ. The delay margin tau-a may be varied in accordance with the tempo.

In summary, the characteristic feature in starting arpeggio performances with the arpeggio playing apparatus of the above-described embodiment having a plurality of arpeggio processing parts #1-#4 resides in that while an arpeggio processing part (e.g. #1 in FIG. 4) has started and is running to play an arpeggio pattern, the other arpeggio processing parts (e.g. #2 and #3 in FIG. 4) will start in synchronism with the rhythm progression timing of the already running arpeggio performance, thereby preventing staggered progressions of arpeggio performances among a plurality of arpeggio processing parts. In the case of the example illustrated in FIG. 4, as the processing part #1 starts an arpeggio performance at the time point t1, the synchronization timing is established (or defined) with the synchronization grids t1, t2, t3, . . . , t7 and so forth according to the progression tempo of the arpeggio pattern in the processing part #1. Then the key-on event for the processing part #2 comes at the time point ta which is after a lapse of more than the delay margin tau-a. The processing part #2 waits until the next coming synchronization grit t3 to start its arpeggio playing. Thereafter, when the key-on event for the processing part #3 comes at the time point tb which is within the delay margin tau-a from the synchronization grid t5, the processing part #3 starts arpeggio playing immediately, shortening the arpeggio pattern to be played up to the time point t6.

Changeover between Regular and Accentuated Arpeggio Patterns

An arpeggio playing apparatus according to an embodiment of the present invention can play an accentuated arpeggio pattern when the key-on velocity (i.e. depression strength) is at or above (equal to or greater than) the predetermined threshold value, while it plays a regular pattern when the key-on velocity is below the threshold value. The changeover timing between the two kinds of patterns can be set to the quantized synchronization grids. FIG. 5 shows how the changeovers between the regular arpeggio pattern and the accentuated arpeggio pattern take place in the embodiment of the present invention.

Where the Quantized ARP Accent Start is set "on" in an arpeggio processing part, when there comes a new key-on event A (with the key-on velocity below the threshold) from the associated key range at a time point t1, the processing part starts arpeggio playing in a regular arpeggio pattern (in a regular track) at the time point t1, which establishes quantized accentuation grids t1, t2, t3, and so forth having a period of the Quantized ARP Accent Value "AQ" which is set for the arpeggio pattern thereby defining a synchronization timing for the changeover to an accentuated arpeggio pattern and vice versa. If the ARP Hold Switch is set "on" in this arpeggio processing part, the arpeggio playing with the regular pattern is kept running even though there is an all-key-off event A at a time point tc.

Thereafter, for example, suppose further key-ons (these may be either a new key-on or an additional key-on) B and C occur at the time points td and tf with a key-on velocity (where there are plural key depressions at a time, the greatest velocity among them) at or above the predetermined threshold value "ARP Accent Vel Threshold." The arpeggio pattern is changed over from the regular pattern to the accentuated pattern according to the Quantized Accentuation Grids t5 and t11, respectively. The reading position of the regular pattern keeps on progressing behind the accentuated pattern reading, as illustrated with dashed lines in FIG. 5. Where there comes an all-key-off event B at the time point te and an all-key-off event C at the time point tg, the respective running accentuated arpeggio patterns are kept on running until the respective ends of the accentuated patterns come at the Quantized Accentuation Grids t7 and t13, respectively, before changing over to the regular pattern.

The changeover timing to the accentuated pattern is controlled in a similar manner as described above about the starts of new processing parts with reference to FIG. 4. More specifically, as the key-on event B occurs at a time point td which is a bit earlier than the next coming quantized synchronization grid t5 (but exceeding a predetermined delay margin tau-b from the preceding quantized accentuation grid t4), the processing part for the accentuated pattern waits until the next coming synchronization grid t5 to start playing the accentuated arpeggio pattern. On the other hand, as the key-on event C occurs at a time point tf which is a bit later than the preceding quantized accentuation grid t11 and falls within the predetermined delay margin tau-b from the quantized accentuation grid t11, the arpeggio pattern is immediately changed over to the accentuated pattern.

In summary, the characteristic feature in changing arpeggio patterns with the arpeggio playing apparatus of the above-described embodiment resides in that each arpeggio pattern to be nominated or designated has a regular pattern version and an accentuated pattern version stored in the memory or storage, and that the regular version is read out and used for an automatic arpeggio performance (in a broken chord) when the velocity of the manipulated key or keys is under the predetermined velocity threshold (AccThreshold), while the accentuated version is read out and used for an automatic arpeggio performance when the velocity of the manipulated key or keys is at or above the predetermined velocity threshold so that strong key manipulations will present arpeggio performances in an enhanced or highlighted fashion. Further, a quantized arpeggio accentuation value which defines the synchronization timing for changing over the arpeggio patterns from the regular version to the accentuated version is prepared or set for each arpeggio pattern so that the time points of changing over the pattern versions are controlled to synchronize with the quantized timing grids (e.g. t5, t7, t11, t13 in FIG. 5), which prevents staggered rhythmic progression between the arpeggio patterns of the regular version and the accentuated version.

Processing Flows

An arpeggio playing apparatus according to the present invention realizes a versatile arpeggio performances by playing a plurality of arpeggio pattern progressions in parallel and changing over pattern versions between the regular one and the accentuated one according to the arpeggio playing computer program. FIGS. 6*a*-9 are flow charts showing the arpeggio playing processing executed in the arpeggio playing apparatus according to an embodiment of the present invention, in which FIGS. 6*a* and 6*b* show, in combination, the procedure of a key-on processing in the arpeggio playing processing including subroutines for an arpeggio start processing and an arpeggio pattern changeover processing as detailed in FIGS. 7 and 8, respectively, and FIG. 9 shows the procedure of a key-off processing in the arpeggio playing processing. The key-on processing of FIG. 6 starts every time a key-on event occurs by the manipulation of the keys in the keyboard KB, and the key-off processing of FIG. 9 starts every time a key-off event occurs by the manipulation of the keys in the keyboard KB.

Key-on Processing

As the key-on processing of FIGS. 6*a* and 6*b* starts, the CPU 1 sets the tone processing part number N to "1" at a step S1 (FIG. 6*a*) before going on to the key-on processing conducted through steps S2-S12 for the processing part #1. The step S2 which is the first step in the key-on processing for the processing part #N (now, N=1) judges whether the key-on event is within the key range for the processing part #N or not. If the key-on event is not for the processing part #N, the judgment at the step S2 is negative (NO) and the process flow skips to a step S13, immediately terminating the key-on processing for the processing part #N. The step S13 is to judge whether or not the key-on processing has finished all the processing parts up to the last processing part number, and if not, the key-on processing is continued for the next processing part number (N=N+1).

On the other hand, when the step S2 judges that the key-on event is within the key range #N, i.e. the judgment is affirmative (YES), the step S3 in turn judges whether or not the arpeggio playing command is "on" for the processing part #N. If the arpeggio playing command is "off" at the processing part #N, the judgment at the step S3 is negative (NO) and the process flow moves to the step S4 to generate tones in the regular way, i.e. not in an automatic arpeggio manner, instructing the musical tone signal generating unit SG to generate a tone signal simply corresponding to the key-on event (i.e. individual key depression). Then, the process flow skips to the step S13, terminating the key-on processing for the processing part #N.

When the step S3 judges that the arpeggio playing command is "on" at the processing part #N, i.e. the judgment is affirmative (YES), the process flow goes forward to the step S5 to judge whether or not the velocity of the key-on is at or above the predetermined velocity threshold value, i.e. Key-On Vel>=AccThreshold. If the velocity is below the velocity threshold value, i.e. Key-On Vel<AccThreshold, the process flow moves to the step S6 which selects the regular version of the arpeggio pattern according to the number of depressed keys and/or the detected chord for the processing part #N. If the velocity is at or above the velocity threshold value, i.e. Key-On Vel>=AccThreshold, the judgment at the step S6 is affirmative (YES) and the process flow goes forward to the step S7 which selects the accentuated version of the arpeggio pattern according to the number of depressed keys and/or the detected chord for the processing part #N. After the pattern selection processing at the step S6 or S7, the processing flow goes to the step S8 (FIG. 6*b*).

The step S8 judges whether or not the key-on event is a new key-on for the processing part #N. If the judgment is affirmative (YES), the step S9 then judges whether or not the hold command is set "on" for the processing part #N. If the judgment is affirmative (YES), the process flow goes forward to the step S10 to judge whether or not the arpeggio playing has yet to start (i.e. not started yet) in the processing part #N.

When the step S9 judges that the hold command for the processing part #N is set "off" (NO), or when the step S10 judges that an arpeggio playing has not started yet in the processing part #N (YES), the process flow goes to the step S11 to conduct an arpeggio start processing, of which the detail is described in the subroutine flow chart of FIG. 7. When the step S8 judges that the key-on event is not a new key-on for the processing part #N (NO), or when the step S10 judges that an arpeggio playing has already started in the processing part #N (NO), the process flow moves to the step S12 to conduct an arpeggio pattern changeover processing, of which the detail is described in the subroutine flow chart of FIG. 8. After the arpeggio start processing of the step S11, or after the arpeggio pattern changeover processing of the step S12, that is, when the key-on processing for the part #N is over, the processing flow goes forward to the step S13.

Arpeggio Start Processing

In the arpeggio start processing shown in FIG. 7, a step A1 judges whether or not the quantized arpeggio synchronization value is set "off." If the judgment is affirmative (YES), the process flow goes to a step A2. The step A2 instructs the musical tone signal generating unit SG to immediately start an arpeggio processing with a regular version arpeggio pattern or an accentuated version arpeggio pattern as selected in the step S6 (FIG. 6*a*) or in the step S7 (FIG. 6*a*). Where the quantized accentuation grid command is set "on," the quantized accentuation grids are activated with the quantized accent value for the selected arpeggio pattern, before returning to the step S13 (FIG. 6*b*).

On the other hand, when the quantized arpeggio synchronization value is set "on" with a specific value, the judgment in the step Al turns out negative (NO), and then a step A3 judges whether or not another processing part has already started arpeggio processing. If no other processing part has started an arpeggio playing yet, the judgment in the step A3 is negative (NO) and the process flow goes to the step A2. The step A2 immediately starts an arpeggio playing with the selected pattern at a prevailing or set progression tempo and activates the quantized synchronization grids according to the quantized synchronization value. Further, where the quantized accentuation grid command is set "on," the quantized accentuation grids are also activated with the quantized accent value for the selected arpeggio pattern, before returning to the step S13 (FIG. 6*b*).

When the step A3 judges that another processing part has already started an arpeggio playing (YES), the process flow moves forward to a step A4 to judge whether or not the key-on event time point is within a predetermined delay margin tau-a (tolerable for starting) from a quantized synchronization grid.

If the key-on event time point is within the predetermined delay margin tau-a from a quantized synchronization grid (YES), the process flow moves forward to a step A5, which instructs the musical tone signal generating unit SG to output all the events of the selected arpeggio pattern up to this time point and immediately start playing the arpeggio pattern remaining after this time point at the progression tempo. The process flow then returns to the step S13 (FIG. 6*b*).

On the other hand, when the step A4 judges that the key-on event time point is outside the predetermined delay margin tau-a (NO), the process flow goes to a step A6, which instructs the musical tone signal generating unit SG to prepare for starting the selected arpeggio pattern performance at the next coming quantized synchronization grid. The process flow then returns to the step S 13 (FIG. 6*b*).

Arpeggio Pattern Changeover Processing In the arpeggio pattern changeover processing shown in FIG. 8, a step P1 judges whether or not there is an instruction to change over the arpeggio pattern from the regular pattern version to the accentuated pattern version. Where the instruction is not a changeover from the regular pattern to the accentuated pattern, for example, as in the case where the regular pattern version is selected by the step S6 (FIG. 6*a*) or where the accentuated pattern version is continuously selected by the step S7 (FIG. 6*a*), the judgment by the step P1 is negative (NO), and the process flow goes to a step P2, which instructs the musical tone signal generating unit SG to change over to (i.e. start) the selected arpeggio pattern keeping the progression timing (rhythm timing within the pattern). The process flow then returns to the step S13 (FIG. 6*b*).

Where the step S7 (FIG. 6*a*) has selected an accentuated arpeggio pattern anew under the condition that a regular arpeggio pattern had been running up until then, the judgment by the step P1 is affirmative (YES), the process flow moves forward to a step P3, which judges whether or not the quantized accentuation command is set "on." If the quantized accentuation command is set "off," the judgment by the step P3 is negative (NO), and the process flow goes to a step P4, which immediately starts arpeggio playing with the selected accentuated arpeggio pattern. The process flow then returns to the step S13 (FIG. 6*b*).

Where the quantized accentuation command is set "on," the judgment by the step P3 is affirmative (YES) and the process flow moves forward to a step P5, which judges whether or not the key-on event time point is within a predetermined delay margin tau-b (tolerable for changing over the patterns) from a quantized accentuation grid. If the key-on event time point is within the predetermined delay margin tau-b from a quantized accentuation grid (YES), the process flow moves forward to a step P6, which instructs the musical tone signal generating unit SG to output all the events of the selected accentuated arpeggio pattern up to this time point and immediately start playing the accentuated arpeggio pattern remaining after this time point. The process flow then returns to the step S13 (FIG. 6*b*).

On the other hand, when the step P5 judges that the key-on event time point is outside the predetermined delay margin tau-b (NO), the process flow goes to a step P7, which instructs the musical tone signal generating unit SG to suspend starting and to prepare for starting the selected accentuated arpeggio pattern performance at the next coming quantized accentuation grid. The process flow then returns to the step S13 (FIG. 6*b*).

Now back to the key-on processing flow in FIG. 6*b*, the step S13 judges whether or not the key-on processing for the processing part #N has been finished for all the parts up to the last part number (in the case of FIG. 2, up to #4). If the key-on processing has not been finished for up to the last part number, the step S13 judges negative (NO), and the process flow loops back to the step S2, after incrementing the part number by one, i.e. N=N+1, at a step S14, and repeats the processing chain of the steps S2 through S12 until the last numbered processing part. When the key-on processing has been finished for all the processing parts, the step S13 judges affirmative (YES), and the process flow returns to the general main routine of the apparatus to stand by for a key-on event or a key-off event.

Key-Off Processing

When a key-off event occurs according to the key release in the keyboard KB, the key-off processing procedure as shown in FIG. 9 starts with the CPU 1 setting the tone processing part number N to "1" at a step R1 before going on to the key-off processing conducted in a step R2 for the processing part #1. The step R2 which conducts the key-off processing procedure for the processing part #N in the following fashion. The processes enumerated in the key-off processing for the processing part #N of the step R2 are conducted only when the key-off event occurs in the key range associated with the processing part #N, and will be passed (i.e. not be conducted) before moving to a step R3, when the key-off event occurs in another key range than for the processing part #N.

Where the arpeggio playing is not set "on," the regular tone extinction is conducted with respect to the individual releases of the depressed keys.

Where all the keys in the associated key range are released (i.e. all-key-off event) under the non-hold mode (i.e. the hold command in this processing part is "off"), the arpeggio playing processing in this processing part is immediately stopped.

Where all the keys in the associated key range are released under the hold mode (i.e. the hold command in this processing part is "on"), the arpeggio playing processing will be kept on running.

Where not all the keys in the associated key range are released under either mode (i.e. whether the hold command is "on" or "off"), the arpeggio playing processing will be kept on running.

After the key-off processing for the processing part #N in the step R2, the process flow proceeds to a step R3, which judges whether or not the key-off processing for the processing part #N has been finished for all the processing parts up to the last part number. If the key-off processing has not been finished for up to the last part number, the step R3 judges negative (NO), and the process flow loops back to the step R2, after incrementing the part number by one, i.e. N=N+1, at a step R4, and repeats the processing of the step R2 until the last numbered processing part. When the key-off processing has been finished for all the processing parts, the step R3 judges affirmative (YES), and the process flow returns to the general main routine of the apparatus to stand by for a key-on event or a key-off event.

The notes (listed in the list of the depressed keys) to be used for playing a broken chord or for detecting a chord in each tone processing part will be determined in the following manner. Under the non-hold mode, every note listed in the list of the depressed keys is used individually. In other words, under the non-hold mode, whenever there is a key depression event, the note is added in the list of the depressed keys, and whenever there is a key release event, the note is deleted from the list of the depressed keys. Under the hold mode, on the other hand, when there is a key depression event, the list of the depressed keys will be renewed with the keys being depressed concurrently at this time, and even when there is a key release event, the note will not be deleted from the list of the depressed keys.

Other Processing

The arpeggio playing processing with an embodiment according to the present invention includes further processes as follows in addition to the above described processing, although not shown in the drawings.

(1) Time Administration

The time counter counts the clock pulse according to the tempo set for an automatic performance and defines timing for the rhythmic progression of an automatic musical performance. More specifically, the timing of the quantized grids are established, and a judgment is made as to whether or not the current time point is at a quantized grid or within the predetermined tolerance margin from a quantized grid.

(2) Playback of Arpeggio Pattern

A selected arpeggio pattern is read out successively in a designated tempo, and the assigned tone processing part generates tone signals of the notes determined by the key-on events for the tone processing part in a broken chord or determined by modifying the note numbers in the arpeggio pattern according to the detected chord based on the key-on events. As the velocity values for the tone generation, the velocity values included in the arpeggio pattern data file may be used, and also the velocity values detected at the key-on events may be used. As these data processing belong to the generally practiced arpeggio processing, detailed descriptions are omitted herein. In the case of the regular arpeggio pattern, when the processing comes to the end of an arpeggio pattern, the processing returns to the head of the pattern to repeat the playback. On the other hand, in the case of the accentuated arpeggio pattern, when the processing comes to the end of an arpeggio pattern, the processing changes over to the regular pattern.

(3) Stop of Arpeggio Pattern

A running arpeggio can be stopped by switching off the arpeggio on/off control (both under the hold mode whether any key is being depressed or not, and under the non-hold mode when any key is being depressed).

Time Length Adjustment of Arpeggio Pattern

In the above description about how the arpeggio patterns are started relative to each other, when a new key-on occurs within a predetermined delay margin (tolerable time range) tau-a from a quantized synchronization grid, an arpeggio pattern is immediately started with its head portion before the key-on time point cut off and with the remaining portion after the key-on time point running forward, and when a new key-on occurs outside the predetermined delay margin tau-a from a aquantized synchronization grid, the start of an arpeggio pattern is suspended until the next coming synchronization grid. Alternatively, the time length adjustment of the arpeggio pattern can be realized, by shortening or elongating the time length for playing the arpeggio pattern as will be described in (a) through (c) hereinbelow. While the following description will be made with respect to the synchronized starts of arpeggio patterns relative to each other, the similar ideas can be applied also to the quantized changeovers of arpeggio patterns between an accentuated version arpeggio pattern and a regular version arpeggio pattern.

(a) Whether or not a key-on event occurs within the predetermined time range tau-a from the synchronization grid, the pattern is to be shortened (compressed) anyway. To explain with reference to the flow chart of the arpeggio start processing shown in FIG. 7, after the affirmative judgment by the step A3 that any other processing part has started an arpeggio processing, the steps A4-A6 be replaced by a step A7 (not shown) which would immediately start an arpeggio playing and output the first span of the arpeggio pattern in a shortened time length such as by the procedure conducted in the step A5 above or by the method as explained below with reference to FIG. 10*a*.

The method shown in FIG. 10*a* is to read out, in the time period between the key-on time point th and the next coming synchronization grid t3, the whole length of the arpeggio pattern existing in the first quantized synchronization span (which is equal to SQ) by shortening (compressing) the whole time length to complete by the synchronization grid t3. The shortening may be uniform through this whole length, or may be nonuniform, for example, being dense in the beginning and getting sparser toward the end. This shortening will give a groovy performance effect by delicately dislocating the rhythm beats.

(b) Whether or not a key-on event occurs within the predetermined time range tau-a from the synchronization grid, the pattern is to be elongated (expanded) anyway. To explain with reference to the flow chart of the arpeggio start processing shown in FIG. 7, after the affirmative judgment by the step A3 that any other processing part has started an arpeggio processing, the steps A4-A6 be replaced by a step A8 (not shown) which would immediately start an arpeggio playing and output the first span of the arpeggio pattern in an elongated time length.

The elongation (expansion) of an arpeggio pattern can be realized by immediately starting the arpeggio pattern upon receipt of a new key-on event, for example, at the time point ti as shown in FIG. 10*b* or at tk as shown in FIG. 10*c*, and reading out the first span (e.g. between the synchronization grids t2 and t3 in these Figs.) of the arpeggio pattern taking time until the second (next to next) coming synchronization span t3.

More specifically, the method shown in FIG. 10*b* is to output, in the time period between the key-on time point ti and the time point tj (corresponding to the head note event or a predetermined length of time), the head fraction of the arpeggio pattern (e.g. of the head note event or of the head chord up to the time point tj) by elongating (expanding) the head fraction, and to thereafter read out the remaining part of the arpeggio pattern after the time point tj according to the regular progression tempo. The method shown in FIG. 10*c* is to read out, in the time period between the key-on time point tk and the second coming synchronization grid t3, the whole length of the arpeggio pattern existing in the first quantized synchronization length (which is equal to SQ) by elongating (expanding) the whole length to complete by the synchronization grid t3. The elongation may be uniform through this whole length, or may be nonuniform, for example, being dense in the beginning and getting sparser toward the end. This elongation will give a groovy performance effect by delicately dislocating the rhythm beats.

(c) The pattern is to be shortened, when the key-on event occurs within a predetermined delay margin from a synchronization grid, and the pattern is to be elongated, when the key-on event occurs outside a predetermined delay margin from a synchronization grid. Although not shown in a figure, the operation can be explained using the flow chart of FIG. 7 and supposing the predetermined delay margin tau-a to be one half of the synchronization grid span SQ. When a key-on event occurs within the tau-a period, the step A4 judges affirmative (YES) and the first span of the arpeggio pattern is read out as compressed within the time period between the key-on time point and the next coming synchronization grid, according to the method in the step A5 or by shortening the first span of the arpeggio pattern (this method may be named as a step A5' replacing the step A5) as explained above with reference to FIG. 10*a*. On the other hand, when a key-on event occurs outside the tau-a period, the step A4 judges negative (NO) and the first span of the arpeggio pattern is read out as expanded within the time period between the key-on time point and the second coming synchronization grid, by elongating the first span of the arpeggio pattern (this may be named as a step A6' replacing the step A6) as explained above with reference to FIGS. 10*b* and 10*c*.

Arrangement and Operation of Tone Processing Parts (Ex. 2)

An arpeggio playing apparatus according to the present invention may also include an automatic musical performance device, in which while an automatic musical performance is running, arpeggios can be started in synchronism with the rhythmic timing of the running automatic performance by shortening or elongating the first span of an arpeggio pattern.

FIG. 11 shows an arrangement of tone processing parts in association with a manual keyboard and an automatic performance processor according to another embodiment of the present invention. The musical tone signal generating unit (tone generating unit) SG comprises sixteen tone processing parts #1-#16, and the tone signals outputted from these processing parts #1-#16 are mixed by a mixer and supplied to the sound system 17 (FIG. 1). Each of the processing parts #1-#16 is capable of setting a tone color (timbre) individually and is capable of selectively setting from which performance channel (MIDI channel) among various performance data providing channels (MIDI channels) to receive performance data such as real-time manual performance data from a keyboard KB as in the manual playing device 14 of FIG. 1, automatic performance data from data tracks Tr1-Tr14 of a sequencer SQ and external performance data (external MIDI input) inputted from an external MIDI apparatus MD. In other words, each of the performance data providing channels is capable of setting via which MIDI channel to output the performance MIDI data so that the performance data outputted from the respective MIDI channels are received by the tone processing parts in which the receiving channel of the same channel number is set.

The tone signal generating unit SG comprises sixteen tone processing parts #1-#16 and four arpeggiators, where each of the arpeggiators can be arbitrarily set for any of the tone processing parts. For example, as shown in FIG. 11, the arpeggiators #1-#4 can be set for the tone processing parts #1, #3, #6 and #16, respectively, and the real-time manual performance data from the keyboard KB, the automatic performance data from the tracks #1-#16 of the sequencer SQ and the external performance data from the external MIDI apparatus MD can be respectively supplied to the tone processing parts, so that arpeggio performances can be implemented in parallel to the regular (non-arpeggio) performances.

In this connection, where the performance data providing channels include automatic performance data providing channels (sequencer tracks), the arpeggio performances are conducted in synchronization with the progression timing of the sequencer SQ. Namely, where the quantized synchronization or the quantized accentuation is set for the arpeggio playing, the quantized grids for the arpeggio playing are established in synchronism with the quantized grids of the progression timing of the running sequencer SQ. Typically, where an automatic performance is first started by the sequencer SQ and an arpeggio playing is thereafter started by the tone processing part having an arpeggiator, the arpeggio performance is conducted in synchronism with the progression timing of the automatic performance by the sequencer SQ. Where an arpeggio playing is first started and an automatic performance by the sequencer SQ is thereafter started while the arpeggio playing is running, the synchronization timing is defined by the earlier started arpeggio playing until the sequencer SQ is started, and after the sequencer SQ is started and is running, the synchronization timing is defined by the progression of the sequencer SQ.

More specifically, the operation will be as follows, if explained with reference to FIGS. 6*a*-9. With respect to an arpeggio playing based on the real-time manual performance data from the keyboard KM, that is, an arpeggio playing by the tone processing part #1 of the second embodiment of FIG. 11, the explanations about the arpeggio start timing and the pattern changeover timing in the key-on processing and the key-off processing by the processing part #N (especially FIGS. 7 and 8) apply to the operation of this tone processing part #1.

For example, when the processing part #1 of the second embodiment is to start arpeggio playing in response to the manual performance on the keyboard KB, the step A3 of FIG. 7 is to judge whether or not any of the processing parts #2-#15 for the sequencer tracks #1-#14 has already started running, and if the judgment is affirmative (YES), the step A4 is to judge whether or not the new key-on in the keyboard KB is within the predetermined time range tau-a from a quantized synchronization grid defined by the running sequencer SQ.

Now referring to FIG. 12, case I shows a condition where a key-on occurs at the time point tp which is within the time range tau-a from the preceding synchronization grid t3. In this case, the arpeggio playing is immediately started and the first span (between t3 and t4) of the arpeggio pattern is shortened and outputted during the time period from the time point tp till the time point t4 similarly as explained above with respect to the step A5 of FIG. 7, the step A5' in paragraph (c) above, the tone processing part #3 of FIG. 4, and FIG. 10*a*. Case 2 and case 3 shows conditions where a key-on occurs at a time point tq which is outside the time range tau-a from the preceding synchronization grid t2. In case 2, the start of the arpeggio playing is suspended to the next coming synchronization grid t3 as explained above with respect to the step A6 of FIG. 7 and the tone processing part #2 of FIG. 4. In case 3, the arpeggio playing is started immediately with the first span (between t3 and t4) of the arpeggio pattern elongated for the time length between tq and t4 as explained above with respect to the step A6' in paragraph (c) above, FIG. 10*b* and FIG. 10*c*.

Alternatively, as explained in paragraph (a) above, the step A7 can be provided in place of the steps A4-A6 of FIG. 7 to shorten the time length to play the first span of the arpeggio pattern anyway (like in case 1 of FIG. 12), whether or not a key-on event occurs within the predetermined time range tau-a from the synchronization grid, or as explained in paragraph (b) above, the step A8 can be provided in place of the steps A4-A6 of FIG. 7 to elongate the time length to play the first span of the arpeggio pattern anyway (like in case 3 of FIG. 12), whether or not a key-on event occurs within the predetermined time range tau-a from the synchronization grid.

While several preferred embodiments have been described and illustrated in detail herein above with reference to the drawings, it should be understood that the illustrated embodiments are just for preferable examples and that the present invention can be practiced with various modifications without departing from the spirit of the present invention. For example, the number of tone processing parts is not limited to the numbers in the embodiments. It should also be understood that the basic arrangement for playing automatic arpeggios, i.e. the procedure to perform broken chords based on the inputted manual performance data from the keyboard can be readily can be practiced by employing the arrangement of various conventionally known arpeggio playing apparatuses.

What is claimed is:

1. An arpeggio playing apparatus comprising:

a musical tone signal generating device including a plurality of arpeggio playing parts each of which is capable of playing an automatic arpeggio with an arpeggio pattern at a progression tempo, the operation of the arpeggio playing part being started in response to a start instruction;

a start instruction detecting device that detects a start instruction for an arpeggio playing part to start the operation; and a start controlling device that controls, under the condition that a first arpeggio playing part has started playing an automatic arpeggio at the progression tempo which defines a synchronization timing including periodically aligned synchronization grids and that a start instruction is received for another arpeggio playing part, the another arpeggio playing part to start the operation thereof in synchronism with the defined synchronization timing.

2. The arpeggio playing apparatus as claimed in claim 1, wherein the start controlling device controls the another arpeggio playing part to immediately start the operation upon receipt of the start instruction for the another arpeggio playing part in such a way that a span of the arpeggio pattern from its head until the position corresponding to a first coming synchronization grid is played in a shortened time length between the receipt of the start instruction and the first coming synchronization grid, and thereafter the arpeggio pattern is played at the progression tempo.

3. The arpeggio playing apparatus as claimed in claim 2, wherein, if the time point at which the start instruction is received locates within a predetermined time range from a preceding synchronization grid that locates just before the start instruction, the start controlling device controls the another arpeggio playing part to immediately start the operation upon receipt of the start instruction for the another arpeggio playing part in such a way that a span of the arpeggio pattern from its head until the position corresponding to a first coming synchronization grid is played in a shortened time length between the receipt of the start instruction and the first coming synchronization grid.

4. The arpeggio playing apparatus as claimed in claim 1, wherein the start controlling device controls the another arpeggio playing part to immediately start the operation upon receipt of the start instruction for the another arpeggio playing part in such a way that a span of the arpeggio pattern from its head until the position corresponding to a first coming synchronization grid is played in an elongated time length between the receipt of the start instruction and the second coming synchronization grid, and thereafter the arpeggio pattern is played at the progression tempo.

5. The arpeggio playing apparatus as claimed in claim 1, wherein, if the time point at which the start instruction is received locates outside a predetermined time range from a preceding synchronization grid that locates just before the start instruction, the start controlling device controls the another arpeggio playing part to start the operation at the first coming synchronization grid in such a way that a span of the arpeggio pattern from its head until the position corresponding to a first coming synchronization grid is played in the time length between the first coming synchronization grid and the second coming synchronization grid, the arpeggio pattern being played at the progression tempo.

6. An arpeggio playing apparatus comprising:

a musical tone signal generating device including an automatic music playing device and an arpeggio playing part that is capable of playing an automatic arpeggio with an arpeggio pattern at a progression tempo, the operation of the arpeggio playing part being started in response to a start instruction;

a start instruction detecting device that detects a start instruction for the arpeggio playing part to start the operation; and a start controlling device that controls, under the condition that the automatic music playing device has started an automatic music performance at the progression tempo which defines a synchronization timing including periodically aligned synchronization grids and that a start instruction is received for the arpeggio playing part, the arpeggio playing part to start the operation thereof in synchronism with the defined synchronization timing.

7. The arpeggio playing apparatus as claimed in claim 6, wherein the start controlling device controls the arpeggio playing part to immediately start the operation upon receipt of the start instruction for the arpeggio playing part in such a way that a span of the arpeggio pattern from its head until the position corresponding to a first coming synchronization grid is played in a shortened time length between the receipt of the start instruction and the first coming synchronization grid, and thereafter the arpeggio pattern is played at the progression tempo.

8. The arpeggio playing apparatus as claimed in claim 7, wherein, if the time point at which the start instruction is received locates within a predetermined time range from a preceding synchronization grid that locates just before the start instruction, the start controlling device controls the arpeggio playing part to immediately start the operation upon receipt of the start instruction for the arpeggio playing part in such a way that a span of the arpeggio pattern from its head until the position corresponding to a first coming synchronization grid is played in a shortened time length between the receipt of the start instruction and the first coming synchronization grid.

9. An arpeggio playing apparatus as claimed in claim 6, wherein the start controlling device controls the arpeggio playing part to immediately start the operation upon receipt of the start instruction for the arpeggio playing part in such a way that a span of the arpeggio pattern from its head until the position corresponding to a first coming synchronization grid is played in an elongated time length between the receipt of the start instruction and the second coming synchronization grid, and thereafter the arpeggio pattern is played at the progression tempo.

10. The arpeggio playing apparatus as claimed in claim 6, wherein, if the time point at which the start instruction is received locates outside a predetermined time range from a preceding synchronization grid that locates just before the start instruction, the start controlling device controls the arpeggio playing part to start the operation at the first coming synchronization grid in such a way that a span of the arpeggio pattern from its head until the position corresponding to a first coming synchronization grid is played in the time length between the first coming synchronization grid and the second coming synchronization grid, the arpeggio pattern being played at the progression tempo.

11. A computer-readable storage medium storing a computer program for playing an automatic arpeggio with a computer comprising a musical tone signal generating device including a plurality of arpeggio playing parts each of which is capable of playing an automatic arpeggio with an arpeggio pattern at a progression tempo and functioning as an arpeggio playing apparatus, the program containing instructions for:

detecting a start instruction for each of the arpeggio playing parts to start the operation; and controlling, under the condition that a first arpeggio playing part has started playing an automatic arpeggio at the progression tempo which defines a synchronization timing including periodically aligned synchronization grids and that a start instruction is received for another arpeggio playing part, the another arpeggio playing part to start the operation thereof in synchronism with the defined synchronization timing.

12. A computer-readable storage medium storing a computer program for playing an automatic arpeggio with a computer comprising a musical tone signal generating device including an automatic music playing device and an arpeggio playing part that is capable of playing an automatic arpeggio with an arpeggio pattern at a progression tempo and functioning as an arpeggio playing apparatus, the program containing instructions for:

detecting a start instruction for the arpeggio playing part to start the operation; and controlling, under the condition that the automatic music playing device has started an automatic music performance at the progression tempo which defines a synchronization timing including synchronization grids and that a start instruction is received for the arpeggio playing part, the arpeggio playing part to immediately start in synchronism with the defined synchronization timing the operation thereof upon receipt of the start instruction for the arpeggio playing part in such a way that a span of the arpeggio pattern from its head until the position corresponding to a first coming synchronization grid is played in a shortened time length between the receipt of the start instruction and the first coming synchronization grid, and thereafter the arpeggio pattern is played at the progression tempo.

13. A computer-readable storage medium storing a computer program for playing an automatic arpeggio with a computer comprising a musical tone signal generating device including an automatic music playing device and an arpeggio playing part that is capable of playing an automatic arpeggio with an arpeggio pattern at a progression tempo and functioning as an arpeggio playing apparatus, the program containing instructions for:

detecting a start instruction for the arpeggio playing part to start the operation; and controlling, under the condition that the automatic music playing device has started an automatic music performance at the progression tempo which defines a synchronization timing including synchronization grids and that a start instruction is received for the arpeggio playing part, the arpeggio playing part to immediately start in synchronism with the defined synchronization timing the operation thereof upon receipt of the start instruction for the arpeggio playing part in such a way that a span of the arpeggio pattern from its head until the position corresponding to a first coming synchronization grid is played in an elongated time length between the receipt of the start instruction and the second coming synchronization grid, and thereafter the arpeggio pattern is played at the progression tempo.

* * * * *